US005246145A

United States Patent [19]

Leoncavallo et al.

[11] Patent Number: 5,246,145

[45] Date of Patent: Sep. 21, 1993

[54] LIQUID DROPPER SPOUT HAVING LOCKABLE PIVOTED CLOSURE CAP

[75] Inventors: Richard A. Leoncavallo, Pittsford; Ravinder C. Mehra, Fairport; Gregory R. Phillips, Geneva, all of N.Y.

[73] Assignee: Nalge Company, Rochester, N.Y.

[21] Appl. No.: 841,840

[22] Filed: Feb. 26, 1992

Related U.S. Application Data

[63] Continuation-in-part of Ser. No. 708,442, May 31, 1991, abandoned, which is a continuation-in-part of Ser. No. 518,465, May 3, 1990, abandoned, which is a continuation of Ser. No. 804,171, Dec. 9, 1991.

[51] Int. Cl.[5] ..... B65D 47/18

[52] U.S. Cl. ..... 222/153; 215/216; 215/237; 222/420; 222/542; 222/546; 222/556

[58] Field of Search ..... 222/153, 212, 215, 542, 222/546, 556, 568, 498; 220/339, 335; 215/216, 237, 223, 224, 225, 235; 604/294, 295, 298

[56] References Cited

U.S. PATENT DOCUMENTS

| | | |
|---|---|---|
| 802,760 | 10/1905 | Hovey . |
| 898,005 | 8/1908 | Rodler . |
| 1,182,515 | 5/1916 | Viragh . |
| 1,662,682 | 3/1926 | Lloyd . |
| 1,676,846 | 7/1928 | Watson . |
| 2,096,802 | 10/1937 | Griner . |
| 2,249,832 | 7/1941 | Hubschman . |
| 2,259,992 | 10/1941 | Binon . |
| 2,342,477 | 2/1944 | Magnenat . |
| 2,439,985 | 4/1948 | Perelson . |
| 2,526,458 | 10/1950 | Bronnenkant . |
| 2,624,907 | 1/1953 | Graham . |
| 2,659,510 | 11/1953 | Jung . |
| 2,663,463 | 12/1953 | Benbury et al. . |
| 2,734,665 | 2/1956 | Flamm . |
| 2,765,488 | 10/1956 | Ruff . |
| 2,765,949 | 10/1956 | Hillman . |
| 2,833,447 | 5/1958 | Thiele . |
| 2,874,881 | 2/1959 | Stull . |
| 2,889,087 | 6/1959 | Paull et al. . |
| 2,950,847 | 8/1960 | Tupper . |
| 2,987,223 | 6/1961 | Armour . |
| 3,045,860 | 7/1962 | Desgagne . |
| 3,054,535 | 9/1962 | Clarey . |
| 3,077,282 | 2/1963 | Eggers . |
| 3,243,838 | 4/1966 | Blumberg . |
| 3,285,256 | 11/1966 | Despard . |
| 3,307,752 | 3/1967 | Anderson . |
| 3,317,274 | 5/1967 | McCormick . |
| 3,394,835 | 7/1968 | Peterson . |
| 3,497,908 | 3/1970 | Zamarra . |
| 3,515,314 | 6/1970 | Waterman . |

(List continued on next page.)

FOREIGN PATENT DOCUMENTS

| | | |
|---|---|---|
| 588244 | 12/1959 | Canada . |
| 2366195 | 8/1979 | Fed. Rep. of Germany . |
| 3129559 | 6/1982 | Fed. Rep. of Germany . |
| 8535205 | 2/1986 | Fed. Rep. of Germany . |
| 1014961 | 8/1952 | France . |
| 2622795 | 11/1987 | France . |
| 644554 | 10/1950 | United Kingdom . |
| 1357512 | 6/1974 | United Kingdom . |
| 2101096 | 1/1983 | United Kingdom . |

*Primary Examiner*—Kevin P. Shaver
*Attorney, Agent, or Firm*—Wood, Herron & Evans

[57] ABSTRACT

A dropper bottle assembly with a dispensing closure having a base adapted to be secured to the bottle and an elongated dropper spout extending from the base to a distal open end and with a separate cap defining a cavity sized to receive the spout therein wherein the cap and closure share cooperating hinge and lock structures for pivotably mounting the cap about a fixed axis and locking the cap closed with the spout opening closed off. The lock and hinge structure are formed on the spout below the opening thereof but spaced from the closure base. The lock mechanism includes cooperating teeth and an index finger or a cooperating spring-arm and a grip bar. The spout is sealed by a surface of the cap or a compliant mat on that surface, the latter being held in place by a rib within the cap.

84 Claims, 11 Drawing Sheets

U.S. PATENT DOCUMENTS

| | | | |
|---|---|---|---|
| 3,603,470 | 9/1971 | Armour . | |
| 3,604,585 | 9/1971 | Towns . | |
| 3,703,975 | 11/1972 | Wittemer . | |
| 3,710,989 | 1/1973 | Armour . | |
| 3,754,639 | 8/1973 | Gellert . | |
| 3,765,578 | 10/1973 | Stull . | |
| 3,768,707 | 10/1973 | Nigro . | |
| 3,802,607 | 4/1974 | Mead . | |
| 3,884,396 | 5/1975 | Gordon et al. . | |
| 3,927,805 | 12/1975 | Stull . | |
| 3,984,028 | 10/1976 | Zinnbauer . | |
| 4,002,275 | 1/1977 | Crowle et al. . | |
| 4,022,352 | 5/1977 | Pehr . | |
| 4,047,495 | 9/1977 | O'Brian . | |
| 4,087,028 | 5/1978 | Lang . | |
| 4,109,821 | 8/1978 | Lutz . | |
| 4,124,151 | 11/1978 | Hazard . | |
| 4,127,221 | 11/1978 | Vere . | |
| 4,146,146 | 3/1979 | Mar . | |
| 4,158,902 | 6/1979 | Chernack et al. . | |
| 4,172,540 | 10/1979 | Erichson . | |
| 4,193,164 | 3/1980 | Okayama . | |
| 4,204,615 | 5/1980 | McCarthy . | |
| 4,209,100 | 6/1980 | Uhlig . | |
| 4,209,114 | 6/1980 | Wilson et al. . | |
| 4,220,248 | 9/1980 | Wilson et al. . | |
| 4,220,253 | 9/1980 | Thomas et al. . | |
| 4,220,262 | 9/1980 | Uhlig et al. . | |
| 4,234,103 | 11/1980 | Strobl, Jr. et al. . | |
| 4,236,653 | 12/1980 | Gach . | |
| 4,257,537 | 3/1981 | Uhlig . | |
| 4,257,561 | 3/1981 | McKinney . | |
| 4,310,105 | 1/1982 | Gach . | |
| 4,353,483 | 10/1982 | Pehr . | |
| 4,377,248 | 3/1983 | Stull . | |
| 4,378,066 | 3/1983 | Sato et al. . | |
| 4,383,618 | 5/1983 | Dougherty . | |
| 4,387,819 | 6/1983 | Corsette . | |
| 4,444,326 | 4/1984 | Musel . | |
| 4,467,931 | 8/1984 | Gach . | |
| 4,513,888 | 4/1985 | Curry . | |
| 4,527,690 | 7/1985 | Schmidts et al. . | |
| 4,533,058 | 8/1985 | Uhlig . | |
| 4,540,090 | 9/1985 | Gelardi et al. . | |
| 4,546,894 | 10/1985 | Suinat et al. . | |
| 4,625,898 | 12/1986 | Hazard . | |
| 4,629,081 | 12/1986 | McLaren . | |
| 4,640,428 | 2/1987 | Chang . | |
| 4,646,916 | 3/1987 | Ishida et al. . | |
| 4,658,547 | 4/1987 | Oboza . | |
| 4,666,036 | 5/1987 | Bourbon . | |
| 4,666,068 | 5/1987 | Bush . | |
| 4,696,408 | 9/1987 | Dubach . | |
| 4,699,283 | 10/1987 | Dubach . | |
| 4,706,813 | 11/1987 | Schneider et al. . | |
| 4,711,360 | 12/1987 | Ullman . | |
| 4,717,050 | 1/1988 | Wright . | |
| 4,718,567 | 1/1988 | La Vange . | |
| 4,723,669 | 2/1988 | Barriac . | |
| 4,726,484 | 2/1988 | Lutz . | |
| 4,727,999 | 3/1988 | Gach . | |
| 4,739,906 | 4/1988 | LoTurco . | |
| 4,742,928 | 5/1988 | Braun . | |
| 4,747,498 | 5/1988 | Gach . | |
| 4,749,108 | 6/1988 | Dornsbusch et al. . | |
| 4,759,455 | 7/1988 | Wilson . | |
| 4,776,475 | 10/1988 | La Vange . | |
| 4,782,964 | 11/1988 | Poore et al. . | |
| 4,787,526 | 11/1988 | Pehr . | |
| 4,790,442 | 12/1988 | Gach . | |
| 4,793,484 | 12/1988 | Schoettle . | |
| 4,807,781 | 2/1989 | Bobinger et al. . | |
| 4,809,874 | 3/1989 | Pehr . | |
| 4,821,898 | 4/1989 | Smalley . | |
| 4,821,899 | 4/1989 | Nycz et al. . | |
| 4,838,441 | 6/1989 | Chernack . | |
| 4,858,776 | 8/1989 | Mehra . | |
| 4,887,747 | 12/1989 | Ostrowsky et al. . | |
| 4,892,208 | 1/1990 | Sledge . | |
| 4,925,041 | 5/1990 | Pehr . | |
| 4,993,606 | 2/1991 | Bolen, Jr. et al. . | |
| 5,002,206 | 3/1991 | Allegretti et al. . | |
| 5,038,957 | 8/1991 | Gross . | |
| 5,048,715 | 9/1991 | Wolff | 220/335 |
| 5,065,876 | 11/1991 | Joyce | 222/153 |
| 5,092,493 | 3/1992 | Pehr | 222/153 |
| 5,121,859 | 6/1992 | Stull | 222/546 |
| 5,141,138 | 8/1992 | Odet et al. | 222/556 X |

LIQUID DROPPER SPOUT HAVING LOCKABLE PIVOTED CLOSURE CAP

RELATED APPLICATIONS

This application is a continuation-in-part of our U.S. application Ser. No. 07/708,442, filed May 31, 1991, (now abandoned), which is a continuation-in-part of our U.S. application Ser. No. 07/518,465, filed May 3, 1990, (now abandoned), both entitled "Dropper Bottle Assembly". This application is also a continuation of our U.S. application Ser. No. 07/804,171 filed Dec. 9, 1991, entitled "Dropper Nozzle and Cover Assembly" which is a continuation-in-part of the aforementioned application Ser. No. 07/708,442. The disclosures of all three of the aforementioned applications are incorporated herein by reference.

BACKGROUND OF THE INVENTION

1. Field of the Invention

The present invention is directed to a dropper bottle assembly used to dispense liquids.

2. Description of the Prior Art

Dropper bottle assemblies are used to dispense a variety of liquids, typically one drop at a time. For example, dropper bottle assemblies are used for the dispensing of liquid reagents in laboratories, dispensing eye medication, dispensing ear medication, or in any other environment where dispensing of a liquid in controlled drop increments is desired.

One typical prior art dropper bottle assembly comprises a plastic bottle, a nozzle or spout section which is press fit onto the bottle and a cap which is threaded onto the bottle. Liquid is dispensed one drop at a time by squeezing the bottle so as to force liquid out the end or tip of the nozzle. Due to the construction of the bottle assembly, leakage is a problem during dispensing. An additional problem with this type bottle construction is that filling of the bottle by the liquid manufacturer requires a two-step assembly process. After the bottle is filled with the appropriate liquid to be dispensed, the nozzle must first be press fit onto the bottle and the cap then threaded onto the bottle. This two-step assembly process typically requires expensive capping equipment.

Another typical prior art dispensing bottle assembly comprises a plastic bottle, a dispensing plastic nozzle threaded onto the neck of the bottle, and a cap threaded onto the nozzle. With this type of bottle assembly, the cap must thread down over the nozzle far enough for the top inner surface of the cap to engage the top of the dropper spout in order to seal the spout against leakage. Mismatch in parts, and over or under tightening of the cap, may result in an inadequate seal and leakage.

Additionally, a serious problem with both types of prior art dropper bottle assemblies is contamination of the liquid to be dispensed. In many instances, such as in laboratories and research centers, a variety of different liquid reagents may be used together. Typically, these reagents are quite expensive and extremely sensitive to contamination. The caps of the bottles are typically taken completely off and placed on a bench during use and are later returned to their respective bottles. The possibility exists that the cap will be replaced on the wrong bottle, thus resulting in cross contamination between different reagents. If recognized, these reagents should be discarded. However, if the user fails to recognize this cross contamination, the continued use of such reagents could result in faulty test results. In addition to cross contamination, great care must be taken to avoid contamination of the cap or the nozzle that may be caused by the fingers of the user or by the surface upon which the cap is placed. In some instances, the user will attempt to hold the cap in his hand while also holding the bottle. This makes dispensing of a liquid cumbersome and presents the possibility of dropping the cap which can also result in contamination.

SUMMARY OF THE INVENTION

Applicants have invented an improved dropper bottle assembly which minimizes or eliminates many of the problems of prior art dropper bottle assemblies. A nozzle or dispensing closure has a base portion matable to the bottle and an elongated spout extending from the top wall of the base portion. A separate cap is pivotably mounted to the closure to pivot over the spout and surround the spout when the cap is closed. The cap and dispensing closure have cooperating locking mechanisms to hold the cap in sealing relationship with the dropper spout. In accordance with the present invention, the locking mechanism of the closure is preferably situated on the exterior of the spout rather than within the spout or on the base portion of the closure. The dispensing closure and mounted cap may be supplied to the liquid manufacturer pre-assembled allowing for one step capping. Additionally, the assembly is easily opened by disengaging the locking mechanism and pivoting the cap over the spout. In this way, the cap is held to the nozzle thus minimizing potential contamination while also permitting simple one hand dispensing.

In accordance with one aspect of the present invention, the dispensing closure supports a hinge mechanism to the side of the spout above the top wall of the dispensing closure to define a pivot axis for the cap which is spaced above the top of the bottle but which allows the cap to pivot over the spout without interference from the portion of the dispensing closure which mates with the neck of the bottle. In accordance with a further aspect of the present invention, the cap is pivotably mounted to the dispensing disclosure by a pair of opposed hinge pins on the cap and a yoke on the dispensing disclosure, or vice versa. The opposed hinge pins have a gap therebetween through which the yoke may be received upon spreading apart the hinge pins to mount the cap to the dispensing closure. To facilitate such mounting, the opposed surfaces of the hinge pins are cammed, or angled, in preferably opposite directions, so as to provide a surface against which the yoke will bear as the cap is pressed onto the dispensing closure to allow for snap-fitting of the cap to the dispensing closure. The hinge pins extend from opposed surfaces of the cap or dispensing closure and are urged towards one another to fit into the yoke until the opposed surfaces supporting the hinge pins meet up with the yoke. These surfaces preferably frictionally engage the planar sidewalls of the yoke to assist in holding the cap in any position of its pivot from closed to fully open.

Preferably, the angle of the hinge pin cammed surfaces defines an everwidening gap from the top to the bottom of the hinge pins as a result of which a maximum bearing surface is provided against the yoke when the cap is closed, while also providing a minimum interface between the hinge pins and the yoke in the fully open position of the cap. As a consequence, the cap will be held securely to the dispensing closure in the closed position, but may be readily snapped-off from the closure in the fully open position. To this end, in those instances where temporary removal of the cap may be desired, camming action between the hinge pins and the yoke in the fully open position of the cap allows for removal of the cap with reduced likelihood of destruction of the hinge mechanism so that the cap may be reapplied for subsequent use.

To facilitate use of the assembly, the cap is preferably relieved above its hinge section so that as the cap is pivoted into the open position, the cap will not impinge against the top of the dispensing closure until the cap is fully open such as at 180°. The relieved area of the cap defines a ledge which cooperates with the dispensing closure in the fully open position of the cap to provide a fulcrum for snapping the cap from the dispensing closure as the cap is pivoted past the fully open position.

In accordance with another aspect of the present invention, the locking mechanism is provided to positively secure the cap in the closed and locked position with the cap sealing the opening of the spout. In one embodiment of the present invention, the locking mechanism comprises one or two rows of teeth disposed on the dispensing closure at the base of the spout and one or two flexible indexing fingers or pawls formed on the cap designed to engage the teeth in a ratchet-like manner as the cap pivots to the closed position. To open the cap, the cap is twisted or rotated slightly until the finger is disengaged from the teeth whereupon the cap may be pivoted open. In another embodiment of the present invention, the locking mechanism comprises a spring-like lock arm and a grip bar designed to engage the lock arm as the cap is pivoted to the closed position and to disengage when force is applied to the grip bar to pivot the cap to the open position without otherwise twisting or rotating the cap. Preferably, the lock arm extends from the dispensing closure near the base of the spout with the grip bar positioned along an edge or lip of the cap. The lock arm and grip bar could be interchanged, however. In either event, the two locking elements have angled mating and ramp surfaces to facilitate closing and unlocking as desired. In a preferred embodiment, the lock arm is J-shaped extending radially from the base of the spout with anti-overstress mechanical stops provided on the J-arm and/or the spout to limit deflection of the J-arm whereby to minimize breakage or other damage thereto.

In accordance with a still further aspect of the present invention, the locking mechanism and hinge assembly are preferably positioned, when the cap is in the closed and locked position, to opposite sides of the spout. Consequently, with the top inner surface of the cap, or any compliant mat or liner therealong, resting against the top of the spout, the lock mechanism exerts a force which translates to a force on the hinge mechanism which places the hinge pins in shear against the yoke. Further, the top inner surface of the cap (or the associated liner) will be compressed against the spout opening and seal off that opening. Preferably, the pivot axis and the locking location are positioned to intersect a pair of lines extending along equal but opposite angles with respect to the longitudinal axis of the spout to thereby avoid eccentric loading and provide desirably longitudinally distributed load characteristics which facilitate fully sealing the spout. Further preferably, the pivot axis and locking location are situated down near the base of the spout (closer to the bottle and removed from the tip of the spout) to provide maximum free length of spout in use, but with the hinge and locking structure extending from the spout and spaced above the dispensing closure top wall to prevent sink marks from forming in the dispensing closure during molding which might adversely affect the seal between the bottle and the dispensing closure.

In accordance with an even further aspect of the present invention, the inner surface of the top of the cap is provided with a seal structure to seat against the spout opening for a better seal. To this end, the seal may be comprised of a fixed or flexible projection on the cap top inner surface which projection seats against the spout opening when the cap is closed. A compliant liner or mat may be placed against the cap top inner surface, overlying the projection, for better sealing action on the spout. Alternatively, the projection on the cap may be dispensed with, and the compliant mat, with or without its own hemispherical projection, may be utilized. In a preferred embodiment, the compliant mat is held in place against the inside top of the cap by one or two longitudinal ribs which frictionally engage edges of the mat. Where the locking mechanism does not require the cap to rotate or twist to disengage, the ribs preferably also extend downwardly through the cap to sit astride the spout when the cap is closed. The extended ribs provide protection against lateral shifting of the cap whereby to reduce the likelihood of the cap becoming unlocked due to lateral loading against the cap such as might occur during shipment.

By virtue of the foregoing, there is thus provided a dropper bottle assembly which reduces or eliminates leakage, assembly, and contamination problems encountered with prior art dropper bottle assemblies. These and other objects and advantages of the present invention shall become more apparent from a detailed description of the invention.

BRIEF DESCRIPTION OF THE DRAWINGS

The accompanying drawings, which are incorporated in and constitute a part of this specification, illustrate the invention and, together with the general description of the invention given above and the detailed description given below, serve to explain the principles of the invention.

DETAILED DESCRIPTION OF THE DRAWINGS

Figures 1, 2, 3:
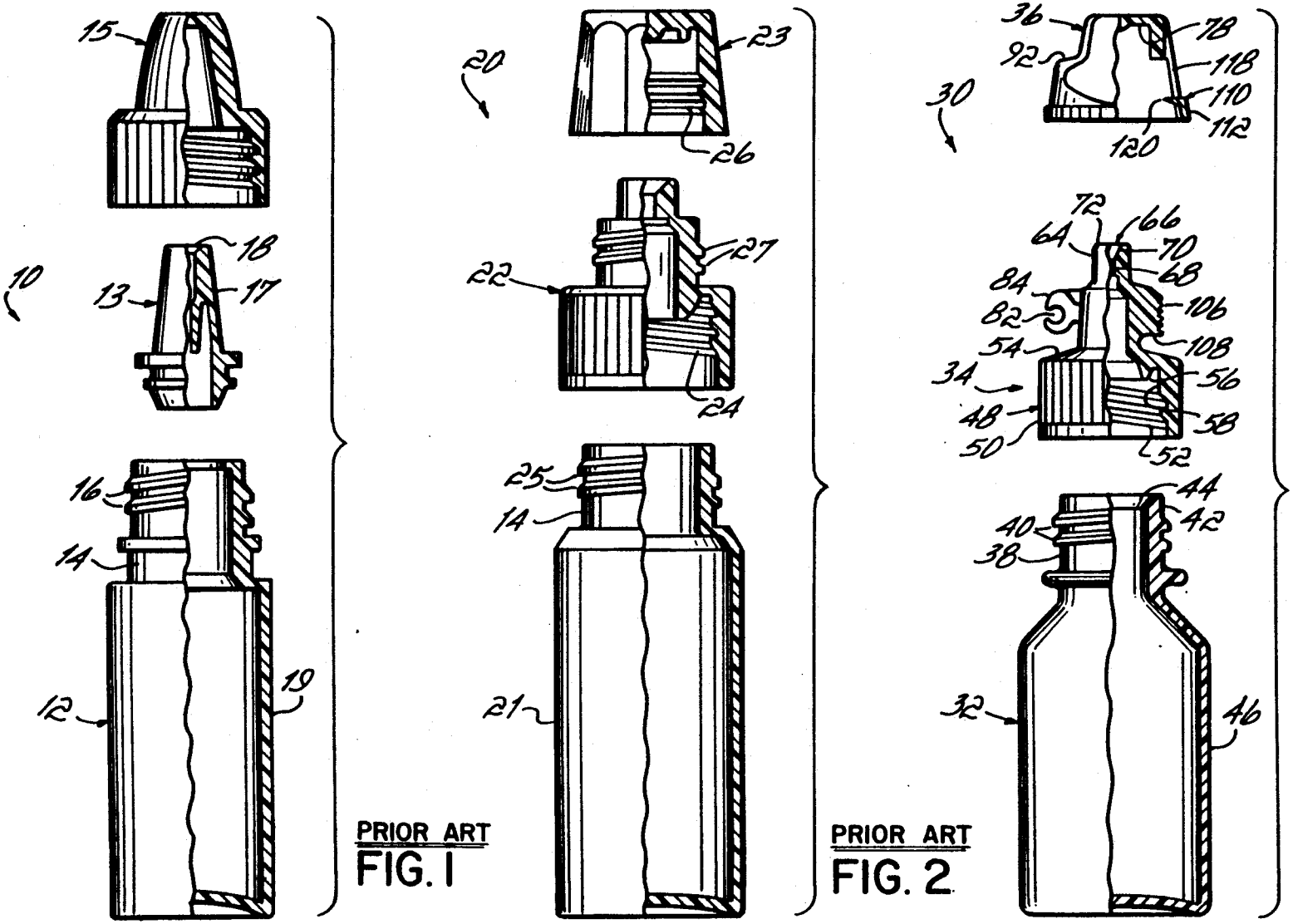
FIG. 3 PRIOR ART
FIG. 2 PRIOR ART
FIG. 1 is a front elevational exploded view, partially in cross-section, of a prior art dropper bottle assembly.
FIG. 2 is a front elevational exploded view, partially in cross-section, of another prior art dropper bottle assembly.
FIG. 3 is an exploded front elevational view, partially in cross-section, of one embodiment of a dropper bottle assembly in accordance with principles of the present invention.
Figure 5:
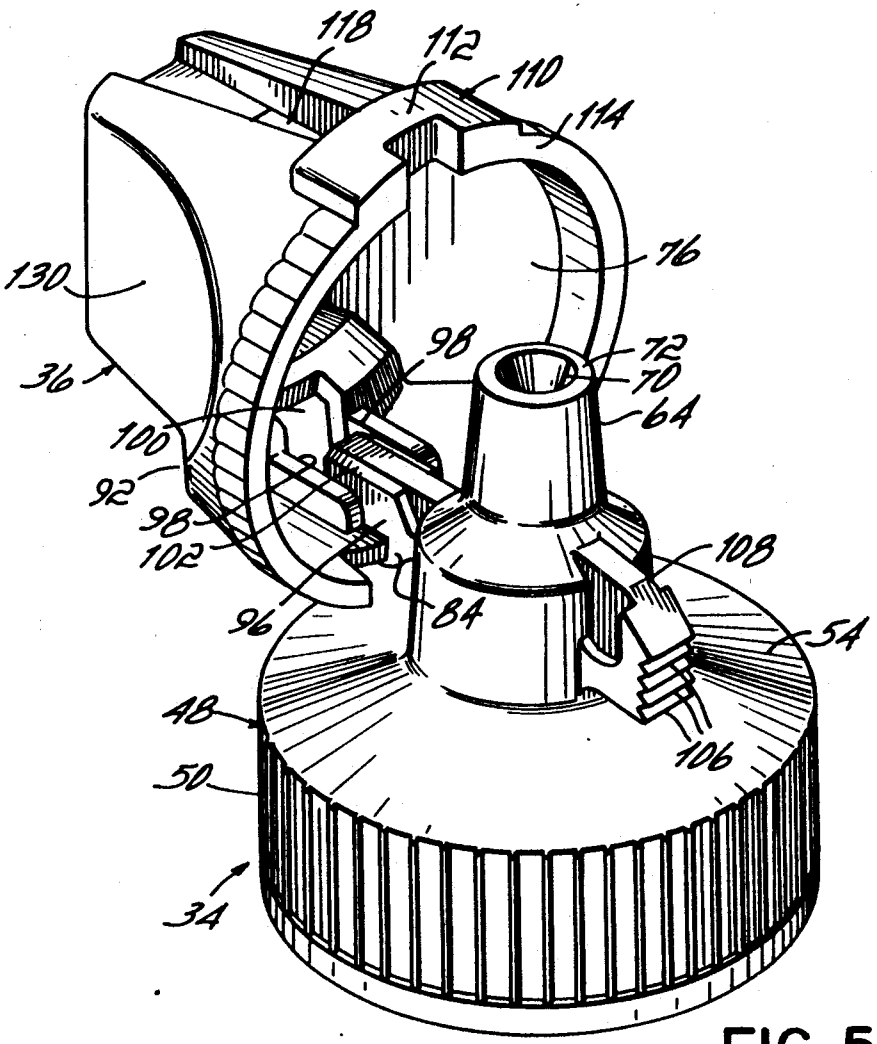
FIG. 5 is a perspective view of the assembled cap and dispensing closure of the dropper bottle assembly of FIG. 3 with the cap positioned between the fully opened and the closed positions.

Referring to FIG. 1, there is illustrated a dropper bottle assembly 10 made in accordance with the prior art which comprises a bottle 12 having a nozzle 13 designed to press-fit within the neck portion 14 of bottle 12, and a cap 15 designed to fit over nozzle 13 and engage threaded portion 16 of neck portion 14. The nozzle 13 has an elongated passageway or spout 17 for allowing fluid within the bottle 12 to be dispensed through outlet 18 in nozzle 13 at the tip of spout 17. As is typical with such prior art bottle assemblies, the bottle 12, nozzle 13 and cap 15 are made of an appropriate plastic material. Liquid is dispensed by first removing cap 15 and then squeezing the cylindrical sidewall 19 of bottle 12 with one's fingers which causes liquid therein to pass through passageway 17 and out of outlet 18. A problem encountered with such prior art devices is that fluid may leak between the nozzle portion 13 and bottle 12 during dispensing. Further, the seal between the cap 15 and outlet 18 is generally inadequate when the cap is firmly secured on the bottle. Another disadvantage of this type structure is that it requires a two step assembly for the product manufacturer after the bottle has been filled with the liquid to be dispensed, i.e., first the nozzle must be snap-fit onto the bottle and then the cap has to be threaded onto the bottle to complete the assembly. This type construction also has serious contamination problems discussed later herein.

Referring to FIG. 2, there is illustrated another bottle assembly 20 made in accordance with the prior art. The bottle assembly 20 comprises a bottle 21, a dispensing nozzle 22 and a cap 23. Dispensing nozzle 22 is secured to neck portion 14 of bottle 21 by appropriate internal threads 24 in nozzle 22 which engage external threads 25 on bottle neck portion 14. Cap 23 is secured to nozzle 22 by internal threads 26 which engage external threads 27 on nozzle 22. This type of construction, as with the other prior art assembly, is subject to serious contamination problems. Cross contamination may occur between several bottle assemblies being used at the same time as the cap of one assembly may be inadvertently placed on the wrong bottle. Further, since the cap is typically completely removed and placed to rest on a supporting surface, the cap may be contaminated by the surface on which it is placed. If the user holds the cap in his hands, dispensing of the liquid becomes quite cumbersome as the user is typically also holding something in the same hand.

Referring to FIGS. 3–13A there is illustrated a first embodiment of a dropper bottle assembly 30 in accordance with the principles of the present invention. Dropper bottle assembly 30 includes a bottle 32, a dispensing closure or nozzle 34, and a cap 36 as will be described. Bottle 32 is preferably of molded plastic and is designed to hold liquid to be dispensed, such as reagents used in laboratories and research facilities by way of example. Bottle 32 includes a neck portion 38 having external threads 40 and an outer rim 42 which defines an outlet 44 of the bottle 32, although bottle 32 may take any desired configuration as is typical for such bottles. Bottle 32 may be made of a low density polyethylene such as CHEVRON 5104, although it will be appreciated that bottle 32 may be made out of any suitable plastic material such as high density polyethylene, PVC, PETG, or PET (stretch blow). It is understood that the bottle material should be compatible with the liquid to be contained therein and that sidewall 46 of bottle 32 preferably be capable of being deflected so as to cause liquid to be dispensed therefrom.

Dispensing closure 34 is designed to mate with neck portion 38 of bottle 32. To this end, base portion 48 of dispensing closure 34 includes an annular skirt 50 having internal threads 52 threadably engaging external threads 40 of bottle neck portion 38. Depending from the top wall 54 of the closure base portion 48 and disposed within annular skirt 50 is an annular sealing ring 56 spaced from the internal surface 58 of skirt 50. Sealing ring 56 is sized, shaped and spaced to provide an annular recess 60 to receive the rim 42 of bottle 32 and provide a seal between closure 34 and bottle 32. Affixed to and extending vertically upwardly from the base portion top wall 54 of dispensing closure 34 is an elongated dispensing section or spout 64 which is in fluid communication with outlet 44 of bottle 32 when assembled as in FIG. 4. Spout 64 includes a dispensing passageway 66 therethrough for allowing a liquid within bottle 32 to pass out of dispensing closure 34 in drops. Passageway 66 includes (see FIG. 10) an axially inner section 68, having a substantially straight cylindrical opening of diameter D equal to about 0.010 inches (0.0254 cm) and an axially outer section 70 which flares from diameter D adjacent inner section 68 and increases as it approaches the outer dispensing or tip end 72 of spout 64 to define a substantially conical configuration. Dispensing closure 34 is preferably molded of a high density polyethylene plastic although other suitable plastic materials may be used.

Figure 9:
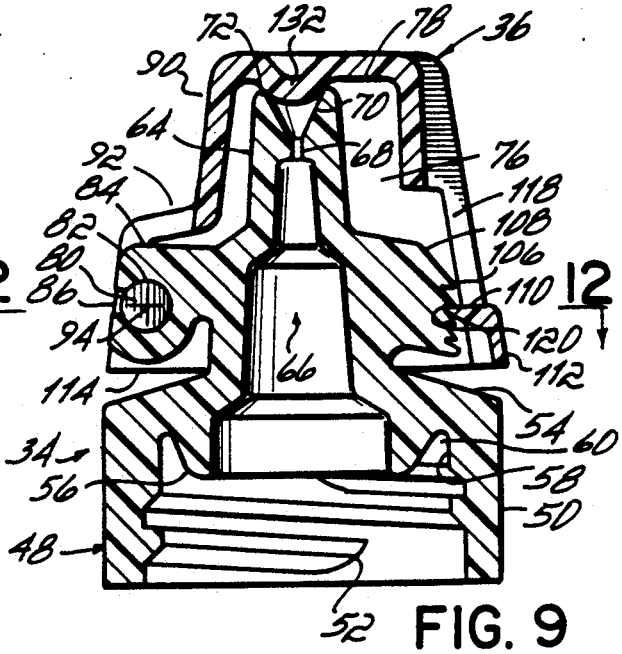
FIG. 9 is a cross-sectional view of the assembled dispensing closure and cap of the dropper bottle assembly of FIG. 5 with the cap in the closed position.
Figure 10:
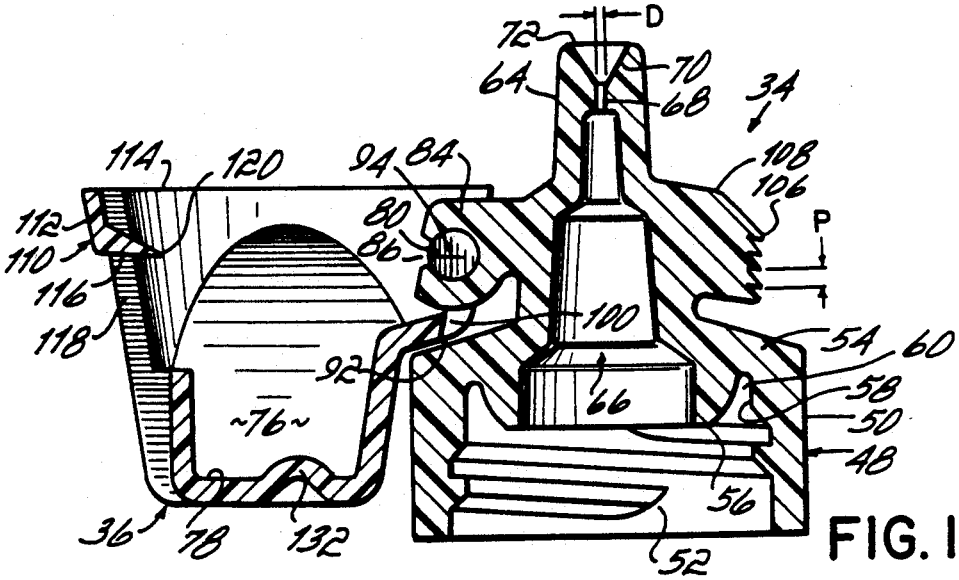
FIG. 10 is a cross-sectional view similar to FIG. 9 with the cap in the fully opened position.
Figure 11:
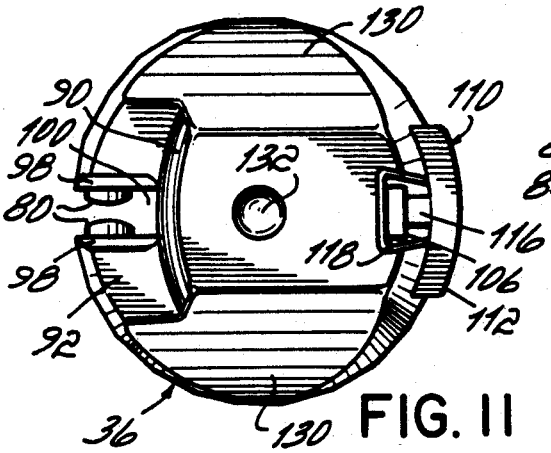
FIG. 11 is a top plan view of the cap of the bottle dropper assembly of FIG. 3.
Figure 12:
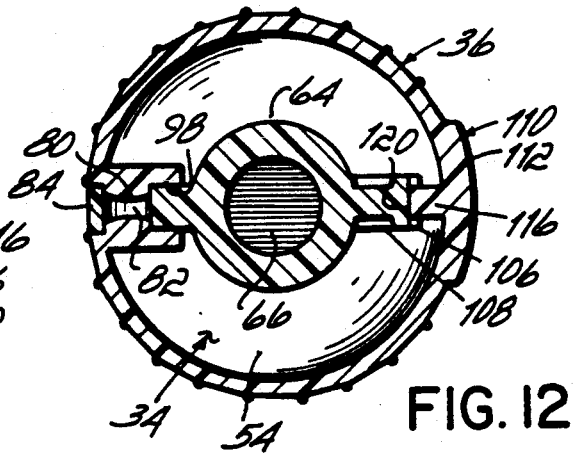
FIG. 12 is a cross-sectional view taken along line 12—12 of FIG. 9.

Molded plastic closure cap 36 is a separate piece from, but is pivotably mounted to, plastic dispensing closure 34 to be pivoted about a fixed axis between a closed and locked position as seen in FIG. 9 and a fully open dispensing position as seen in FIG. 10 for dispensing liquid from bottle 32. Cap 36 defines an inner cavity or space 76 into which spout 64 is received as cap 36 is pivoted to the closed position (see FIG. 5). In that closed position (see FIG. 9), spout 64 is surrounded by cap 36 with the top inner surface 78 of cap 36 in sealing engagement (directly or via a projection and/or a compliant mat as will be described) with tip end 72 of spout 64.

Figure 6:
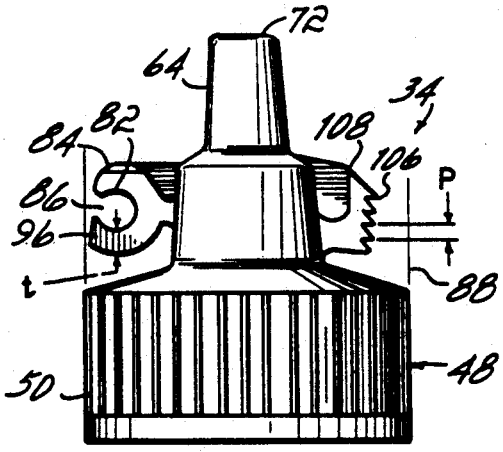
FIG. 6 is a front elevational view of the dispensing closure of the dropper bottle assembly of FIG. 3.

Cap 36 is pivotably mounted to dispensing closure 34 by a hinge mechanism such as defined by a pair of axially aligned substantially cylindrically shaped projections or hinge pins 80 molded in cap 36 and which rotate in circular opening 82 formed in retaining member or yoke 84 which is integrally molded as part of closure 32 (see FIGS. 6, 9 and 10). Yoke member 84 may completely enclose the periphery of opening 82 or may be substantially C-shaped with a portion cut-away as at 86 to confine yoke member 84 within cylinder 88 defined by the outer periphery of nozzle skirt 50 (FIG. 6) such that with cap 36 attached thereto and in the closed position, cap 36 is also substantially confined within cylinder 88 (see FIGS. 4, 9 and 11, for example). To facilitate pivoting of cap 36 a full 180° to the open position, cap 36 is relieved as at 90 (see FIG. 4 for example) to define a ledge 92 which rests adjacent top wall 54 of dispensing closure 34 as seen in FIG. 10. Yoke member 84 is designed to be substantially rigid so as to resist any substantial deformation that may result from cap 36 being placed in the closed position. Member 84 has a width W, thickness t, and a configuration designed so that it can be integrally molded as part of closure 34. The opening 82 in member 84 is preferably slightly larger than the diameter of projections 80 to allow cap 36 to thereby pivot about fixed axis 94 along the longitudinal axes of projections 80. Further, sidewalls 96 of yoke 84 are preferably substantially planar and are frictionally engaged by the opposed sidewalls 98 of cap 36 which support projections 80 in the area of cap cutaway 100 to permit cap 36 to be positioned at any position along its path of pivot between open and closed (see, e.g., FIG. 5). Moreover, sidewalls 98 bear against sidewalls 96 of yolk 84 in any position of the cap to thereby limit wobble of cap 36 as it is opened and closed. It will be understood, however, that alternative locking structure may be provided to maintain the cap in the open dispensing position, for example, through the use of indexing projections (not shown) between cap 36 and dispensing closure 34 or to allow positive positioning of cap 36 in any position along its path of rotation.

Cap 36 is a separate integrally molded part. The configuration of projections 80 and retaining member 84 allows easy installation of cap 36 to dispensing closure 34. The flexibility of projections 80 and adjacent sidewalls 98 allows cap 36 to be mounted to dispensing closure 34 by simply pushing cap 36 on to closure 34 so as to snap projections 80 into opening 82. Yoke 84 may be bevelled as at 102 to provide camming action to separate projections 80 and sidewalls 98 as projections 80 slide onto yoke 84 after which sidewalls 98 urge projections 80 into yoke 84 with respective sidewalls 96,98 in engagement. Therefore, cap 36 is easily captured on closure 34, avoiding the necessity of completely removing cap 36 and preventing contamination thereof while also allowing easy use of the bottle during dispensing.

Figure 4:
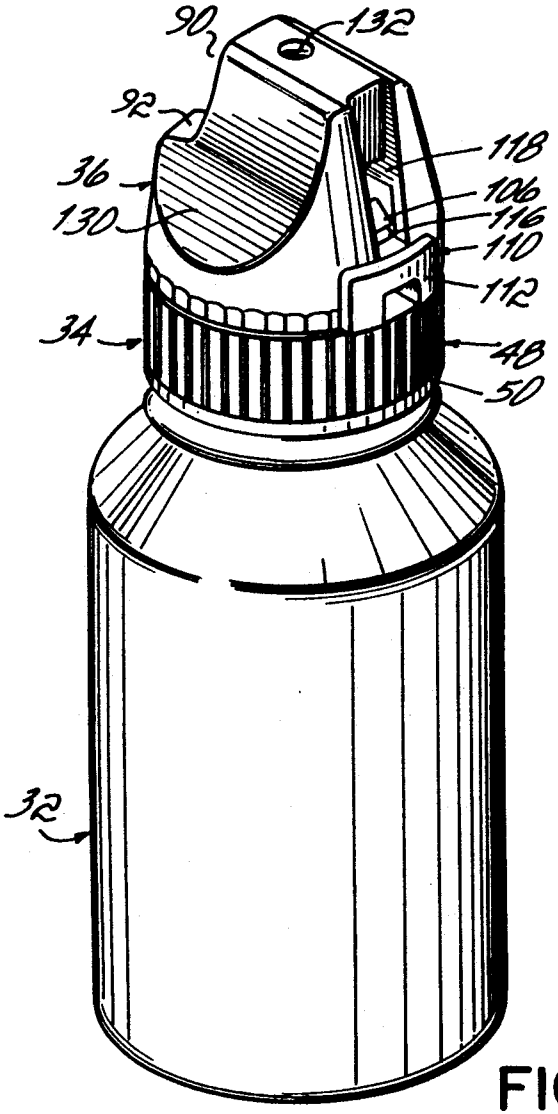
FIG. 4 is a perspective view of the assembled dropper bottle assembly of FIG. 3 with the cap in the closed position.
Figure 7:
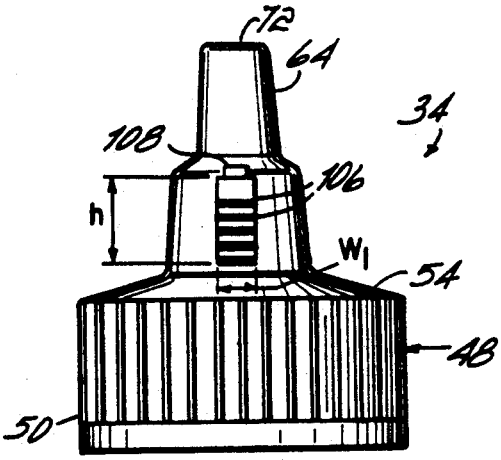
FIG. 7 is a right side elevational view of the dispensing closure of FIG. 6.
Figure 8:
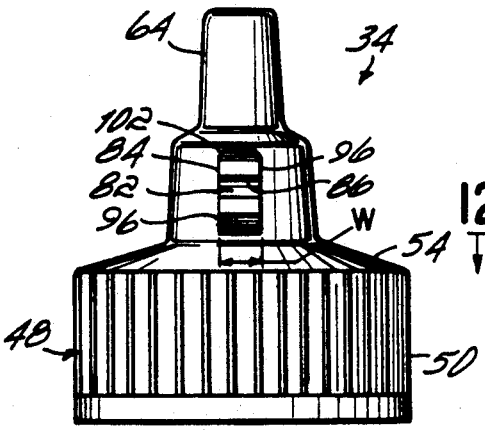
FIG. 8 is a left side elevational view of the dispensing closure of FIG. 6.

To secure cap 36 in the closed position, a cooperating locking mechanism is provided on cap 36 and dispensing closure 34 comprising a plurality of vertically aligned locking teeth 106 disposed on the outer surface of projection 108 (FIG. 6) integrally formed at the base of spout 64 and a flexible indexing finger 110 formed on cap 36 (FIGS. 9 and 10) designed to engage teeth 106 as cap 36 is pivoted to the closed position. Projection 108 has a height h and width W1 (FIG. 7) which allows it to be integrally molded as a part of dispensing closure 34 with teeth 106 having a pitch P (FIG. 6.) of about 0.025 inches (0.0635 cm), although, pitch P may be selected to any desired increment. Teeth 106 are formed in a vertical row generally parallel spout 64 with each of teeth 106 oriented in a substantially horizontal direction as illustrated in FIG. 7. Indexing finger 110 is preferably integrally formed with cap 36 and includes a first substantially vertical section 112 which extends from the lower rim or lip 114 of cap 36 and a substantially radially inwardly extending section 116 directed toward the cavity of cap 36. Preferably, indexing finger 110 is substantially surrounded within opening 118 of cap 36 as seen in FIGS. 4 and 10 with sections 112 and 116 free to flex therein. Cap 36 is made of an appropriate plastic material, such as polycarbonate or acetal, to provide flexibility and durability and to allow repeated flexure of indexing finger 110 without damage or taking a permanent set.

In order to lock cap 36 closed on plastic dispensing closure 34, cap 36 is pivoted to the closed position illustrated in FIG. 9 which causes the inner end tip 120 of radially extended finger section 116 to ratchet down over generally non-yielding teeth 106 as it slides thereover and then to seat into one of the appropriate spaces provided between teeth 106. Thereafter, cap 36 is released and held in position by indexing finger 110 engaging the adjacent tooth.

Figure 13:
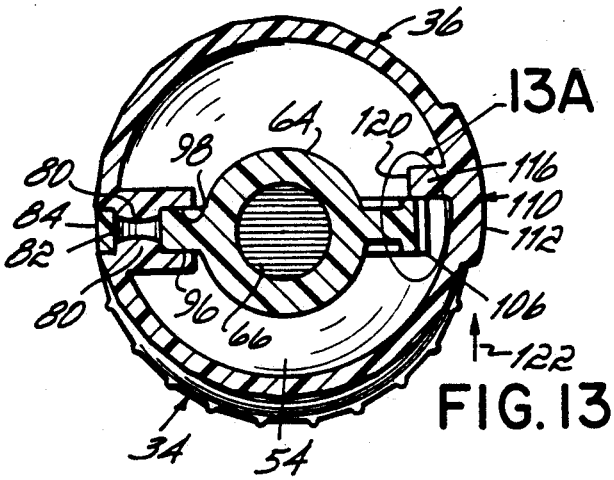
FIG. 13 is a view similar to FIG. 12 illustrating the cap in a deformed state illustrating unlocking of the cap for opening.
Figure 13A:
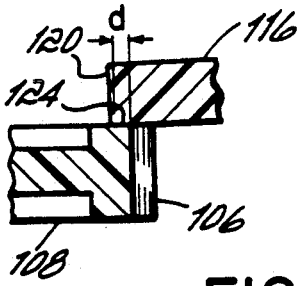
FIG. 13A is a greatly enlarged view of a portion of FIG. 13 as outlined by line 13A.

In order to release or disengage cap 36 from its locked position, a substantially axial force, such as by gripping cap 36 and twisting with the fingers, is applied to cap 36 as indicated by arrow 122 in FIG. 13 to cause cap 36 to flex or deform a sufficient amount that indexing finger 110 slides axially past the side 124 of teeth 106 as seen in FIG. 13A such that indexing finger 110 is disengaged from locking teeth 106. To encourage gripping cap 36 to apply the necessary axial force for opening, the sidewalls 130 of cap 36 are sloped as seen in the Figures. Since a sliding action is used to disengage index finger 110, the force required is substantially dependant upon the resistance to axial movement and is relatively independent of the amount of locking force being applied to finger 110 in the vertical direction. Indexing finger 110 is designed such that when in the normal unengaged position, its inner end 120 extends radially inward of the bottom of teeth 106 such that once the indexing finger becomes disengaged it will be positioned inward of teeth 106 a distance d, as illustrated in FIG. 13A. Thus, once finger 110 is disengaged, cap 36 will not automatically re-lock. Rather, cap 36 must be pivoted back upwards towards the open position and then brought back down to re-engage finger 110 into teeth 106 as previously described. During dispensing of a liquid, cap 36 is pivoted towards the open position illustrated in FIG. 10 which avoids the necessity of placing cap 36 on a bench or holding it during dispensing. Consequently, potential contamination problems as encountered with prior art bottles are minimized or eliminated while still allowing for easy use of dropper bottle assembly 30.

To seal spout 64, cap 36 is provided with an inwardly directed projection or dimple 132 which depends from cap top inner surface 78 towards the interior or cavity 76 of cap 36. Projection 132 is positioned such that it will engage tip end 72 of spout 64 in the closed position of cap 36 (FIG. 9). Projection 132 is substantially hemispherical or dome shaped such that as cap 36 pivots into the locked position, projection 132 engages the substantially conical surface defined in outer section 70 of spout 64 providing an annular seal therebetween. The flexible plastic material of cap 36 provides substantially constant force against the outer surface of spout outer section 70 when the cap is in the locked position. Typically a force of about 10 pounds must be applied to lock cap 36 in the closed position.

Preferably, yoke 84 and teeth 106 are positioned near the base of spout 64 to provide ease of use of assembly 30, but are not directly integral top wall 54 of closure 34 so as not to create sink marks in closure 34 which might adversely affect the seal between bottle 32 and closure 34. Also, although yoke 84 and teeth 106 are shown on closure 34 with projections 80 and indexing finger 110 on cap 36, yoke 84 or teeth 106 could be formed on cap 36 and projections 80 or indexing finger 110 formed on closure 34, respectively.

Figure 14:
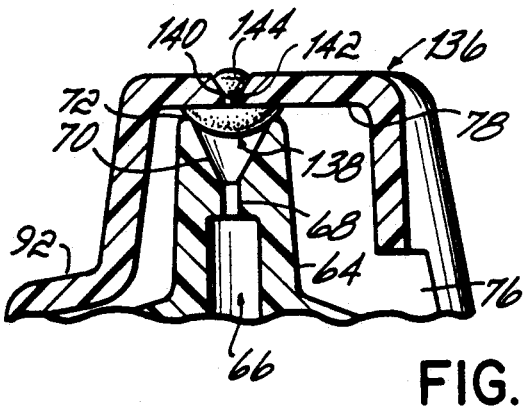
FIG. 14 is a partial cross-sectional view of a modified cap made in accordance with the principles of the present invention with the cap closed about the dispensing closure spout.

Referring to FIG. 14 there is illustrated in partial cross-section a modified cap 136 which is similar to cap 36 but is provided with alternate structure to seal spout 64. Specifically, cap 136 is provided with flexible projection 138 made of an appropriate elastomeric or rubber material which is capable of greater conformation (as opposed to the plastic material of the cap or dispensing closure) whereby to better conform and seal outer section 70 of spout 64. Projection 138 includes an elongated retainer section 140 which is press fit into an opening 142 provided in cap 136. The outer end 144 of projection 138 has a substantially spherical shape so as to assist in retaining projection 138 onto cap 136. However, projection 138 may be secured to cap 136 in any desired manner, for example by the use of an adhesive or other mechanical locking arrangement.

Figure 15:
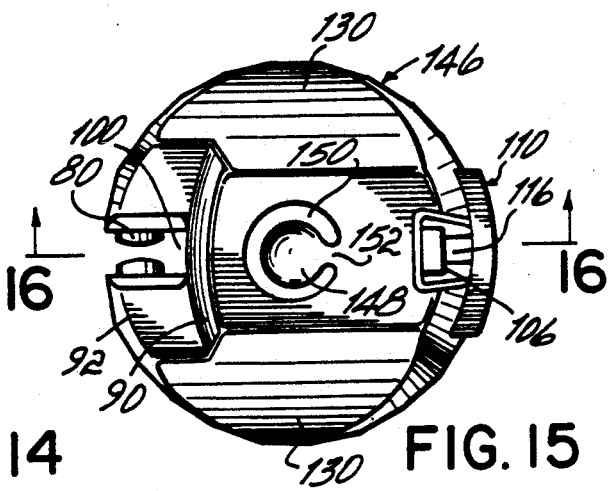
FIG. 15 is a top plan view of yet another modified cap made in accordance with the principles of the present invention.
Figure 16:
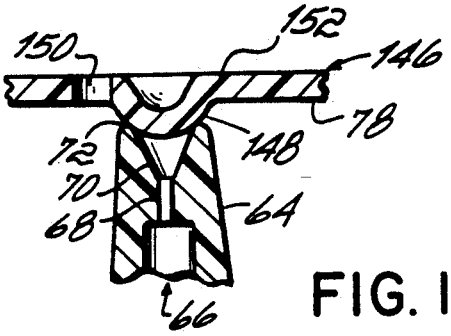
FIG. 16 is a partial cross-sectional view of the cap of FIG. 15 taken along line 16—16 shown sealing the spout of the dispensing closure.
Figure 17:
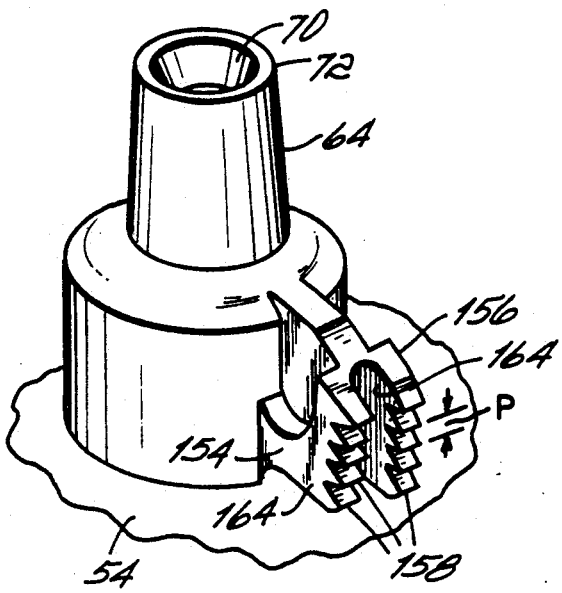
FIG. 17 is a partial perspective view of a modified dispensing closure made in accordance with the principles of the present invention.
Figure 18:
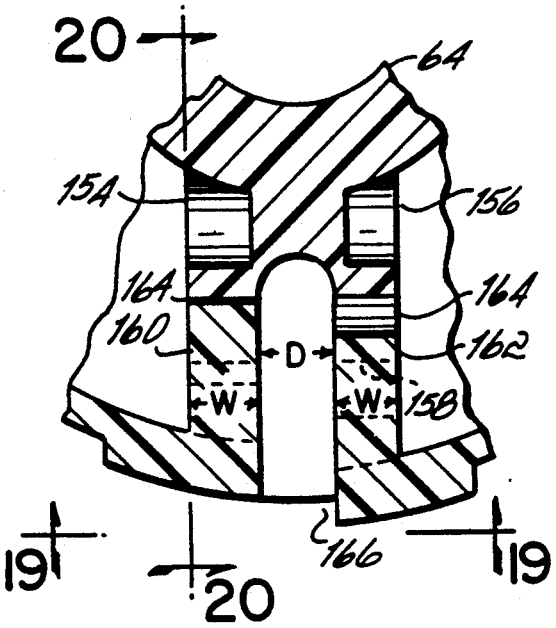
FIG. 18 is an enlarged cross-sectional view (similar to FIG. 12) of the dispensing closure of FIG. 17 as it engages the cap to lock the cap in the closed position.

Referring to FIGS. 15 and 16 there is illustrated yet another modified cap 146 which is also similar to cap 36 but includes a molded-in flexible projection 148 and an opening 150 extending around projection 148 so as to form a flexible connecting portion or tab 152. Opening 150 may extend about 300° around projection 148. When cap 146 is in the closed and locked position, the flexible nature of projection 148 allows it to seat within spout tip 72 in sealing engagement with outer section 70.

Figure 19:
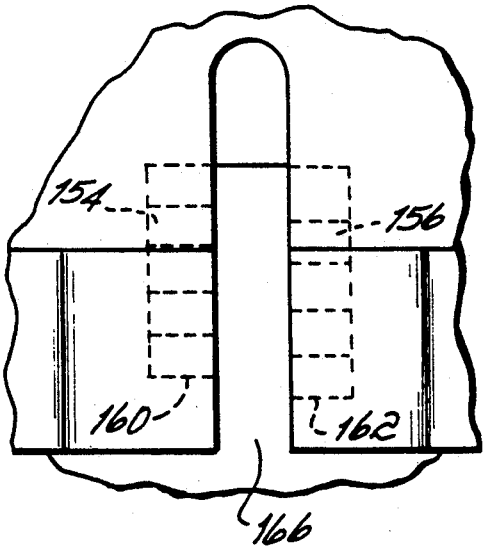
FIG. 19 is a side elevational view taken along line 19—19 of FIG. 18.
Figure 20:
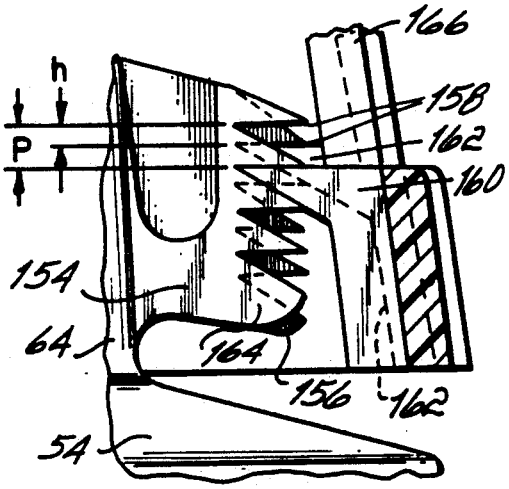
FIG. 20 is a partial cross-sectional view taken along line 20—20 of FIG. 18.

Referring to FIGS. 17–20, there is illustrated a modified locking mechanism for the dispensing closure and cap in accordance with the principles of the present invention. In particular, instead of one row of teeth and one indexing finger described above, two staggered rows of teeth and two indexing fingers are included by which to provide a greater number of locking positions. To this end, closure 34 is modified to have a pair of spaced projections 154,156 molded on the exterior of spout 64 near the bottom thereof, each projection 154,156 having a plurality of teeth 158 having a pitch P. The teeth 158 of projection 154 are disposed approximately midway between the teeth 158 of projection 156 and, as illustrated in FIGS. 19 and 20, are staggered by a distance h which is about one half of pitch P. Similarly, cap 36 is modified to have a pair of independent indexing fingers 160,162 which are designed to alternately engage teeth 158 of projections 154,156 as the cap pivots into the closed position as shown in FIG. 20. To this end, indexing fingers 160,162 alternatively slide over teeth 158 of projection 154 and 156. Depending upon how far the cap can be pushed down will determine which indexing finger 160 or 162 will engage a tooth 158 so as to secure the cap in the locked position. By providing two spaced rows of teeth 158, the size and pitch of the teeth may remain sufficiently large so as to provide a secure engagement between the indexing finger and adjacent tooth. As the cap is pressed down, either indexing finger 160 or 162 will lock the cap closed while the other indexing finger will slide down on an adjacent tooth as illustrated by dash lines in FIG. 20.

The modified cap is unlocked and pivoted open in the same general manner as previously described by flexing or deforming the cap such that indexing fingers 160 and 162 slide past the sides 164 of projections 154,156. Indexing fingers 160,162 are urged forwardly toward spout 64 so as to prevent re-engagement with the adjacent teeth. The space D between projections 154,156 is greater than the width W of indexing fingers 160,162 so that they can easily disengage the adjacent tooth 158. Indexing fingers 160,162 may be spaced apart and separated as at 166 to allow free independent movement.

Figure 21:
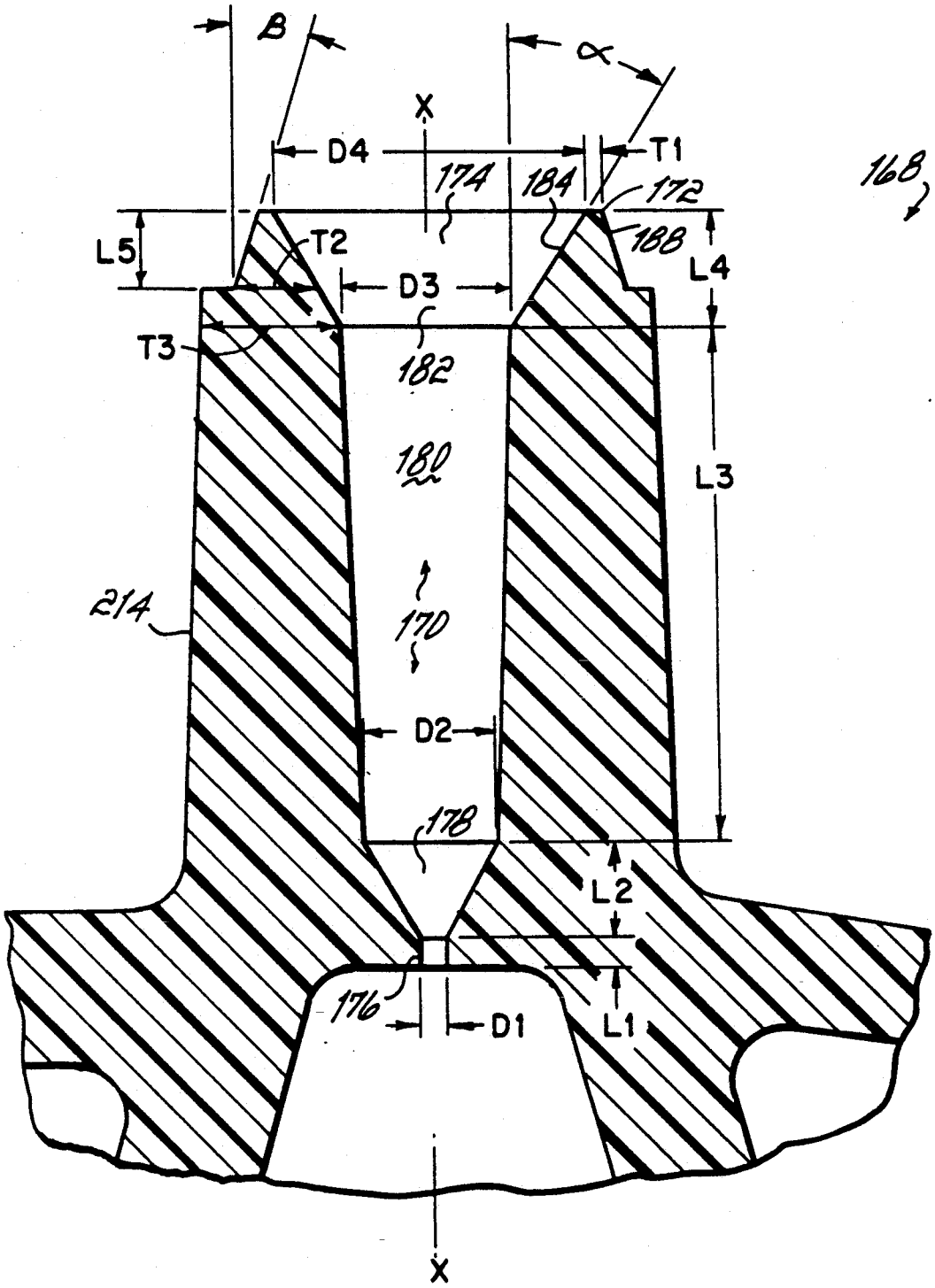
FIG. 21 is an enlarged cross-sectional view of another modified dispensing closure made in accordance with the principles of the present invention.
Figure 22:
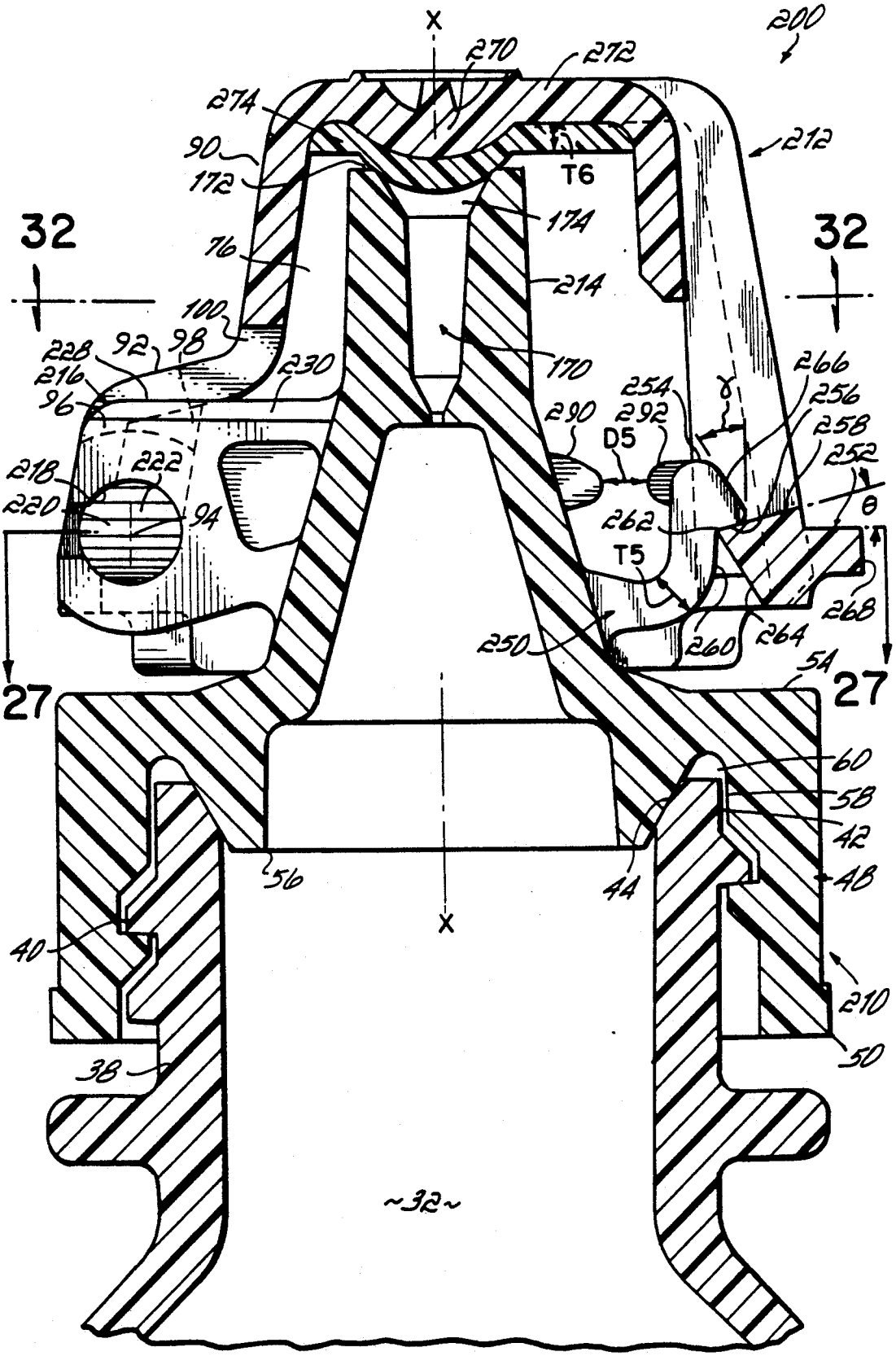
FIG. 22 is a cross-sectional view of a second embodiment of an assembled dropper bottle assembly made in accordance with the principles of the present invention with the cap in the closed position.

Referring to FIG. 21, there is illustrated an enlarged partial cross-sectional view of a modified dispensing closure 168 in which the liquid passageway 170 has been modified from that shown in connection with closure 34. More specifically, outer tip 172 adjacent outlet 174 has been configured so as to provide greater compliance to provide better sealing relationship with projection 132 in cap 36 when cap 36 is placed in the closed position. Further, dispensing passageway 170 comprises four discrete sections which assist in accurately controlling of the dispensing of individual drops. Passageway 170 has an inner section 176 having a diameter D1, and length L1, wherein L1 is about 0.10 inches (0.254 cm)

and D1 is about 0.010 inches (0.254 cm). Adjacent inner section 176 is first conical transition section 178 which increases to a diameter D2 and has a length L2, wherein diameter D2 is about 0.047 inches (0.119 cm) and L2 is about 0.032 inches (0.0813 cm). Adjacent outer end of conical transition section 178 is disposed a second conical section 180 which has a diameter D2 at its outer end and a length L3. A fourth, outer section 182 is disposed adjacent second conical section 180 to form outlet 174 having a diameter D4. D3 is about 0.060 inches (0.152 cm), L3 is about 0.184 inches (0.467 cm), D4 is about 0.110 inches (0.279 cm), and L4 is about 0.043 inches (0.109 cm). It is, of course, understood that the above dimensions may be varied as desired. Section 182 has a conical surface 184 which forms an angle $\alpha$ with respect to the longitudinal axis X—X of passageway 170, wherein angle $\alpha$ is about 30°. While angle $\alpha$ may be varied as desired, it is preferably no more than about 45°. Tip 172 adjacent outlet 174 has a thickness T1 and an outer surface 188 disposed at an angle $\beta$ so that tip 172 increases to a thickness T2 at a length L5. T1 is about 0.005 inches (0.0127 cm), T2 is about 0.042 inches (0.1067 cm) and L5 is about 0.030 inches (0.0762 cm). The values for T1, T2, and L3 are selected such that tip 172 is sufficiently complaint so as to conform to projection 132 in cap 36 whereby to assist in providing a liquid tight seal therebetween. The thickness of closure 168 goes to T3 at the lower end of tip 172 so as to provide the desired rigidity for the remaining portion of closure 168, wherein T3 is preferably about 0.049 inches (0.229 cm), although a different thickness may be employed as desired to provide the degree of rigidity desired. The material selection will, of course, also affect the selection of T1, T2, and L3 to obtain the desire compliance. In the particular embodiment illustrated, closure 168 is made of a high density polyethylene.

Figure 28:
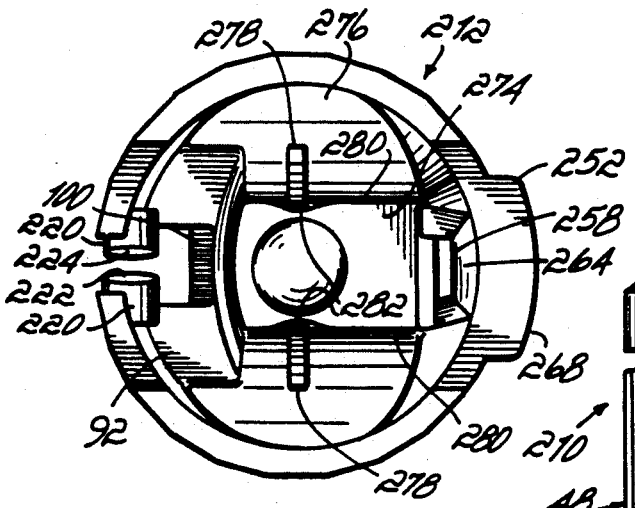
FIG. 28 is a bottom plan view of the cap of the dropper bottle assembly of FIG. 22.
Figure 29:
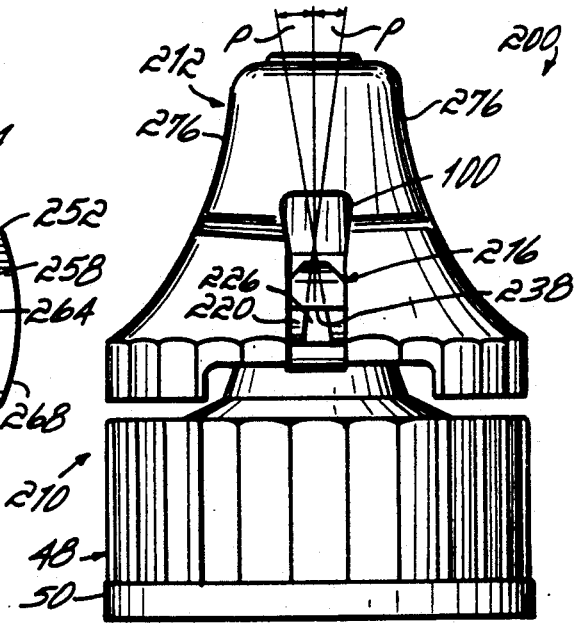
FIG. 29 is a left side elevational view of the dispensing closure and cap of FIG. 22.
Figure 30:
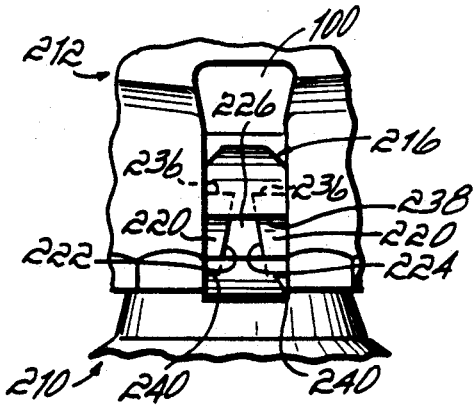
FIG. 30 is a partial left side elevational view of the dropper bottle assembly of FIG. 22.

Referring to FIGS. 22–33, there is illustrated another embodiment of a dropper bottle assembly 200 in which there is provided a modified dispensing closure 210 and modified ca 212 in accordance with the principles of the present invention. Dispensing closure 210 engages bottle 32 in the same manner as closure 34 previously described and has an elongated dropper spout 214 with a fluid passageway 170 similar to that previously described in connection with FIG. 21 for dispensing fluid in drops from bottle 32. Further, cap 212 is pivotably mounted to closure 210 in the same manner as cap 36 is mounted to closure 34. To this end, closure 210 includes apertured yoke member 216 designed to snugly receive in opening 218 thereof a pair of cylindrical hinge pin projections 220 molded in cap 212 and extending from opposed sidewalls 98 within cutaway 100 as in the case of projections 80 of cap 36. Hinge pins 220 preferably include cammed surfaces 222 and 224 (see FIG. 28) to facilitate use and assembly. More specifically, cammed surfaces 222 and 224 are oppositely angled at an angle $\rho$ with respect to a plane through the longitudinal axis X—X of spout 214, which angle is preferably about 10°, to define a gap 226 which is everwidening from the top to the bottom of the hinge pins as seen in FIG. 29. With sidewalls 98 normally being spaced apart about 0.085 inches (2.16 mm) apart, and pins 220 being about 0.090 inches (2.29 mm) in diameter, gap 226 ranges in width from about 0.030 inches (0.76 mm) to about 0.060 inches (1.52 mm).

Figure 23:
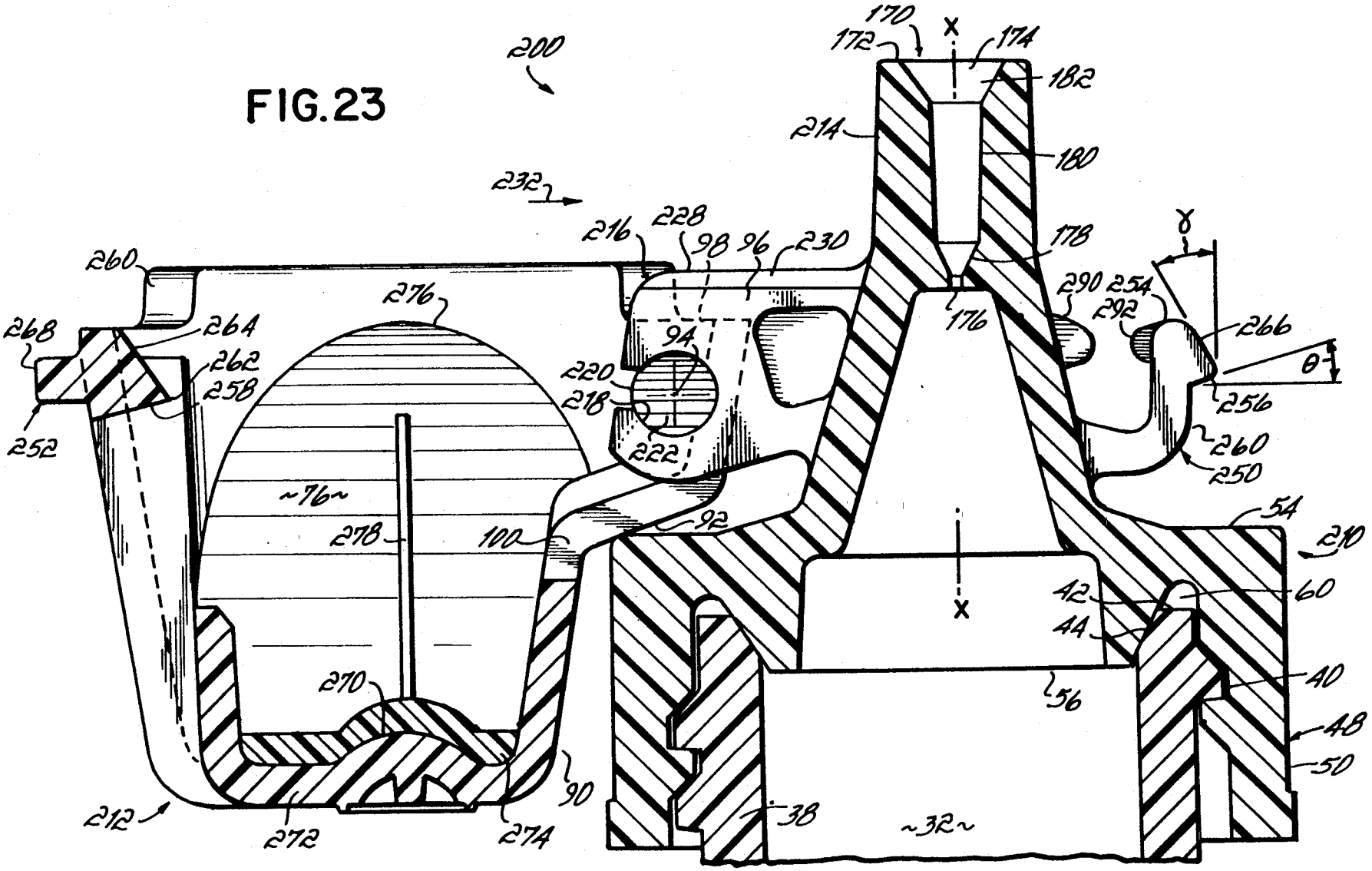
FIG. 23 is a view similar to FIG. 22 with the cap in the fully opened position.
Figure 24:
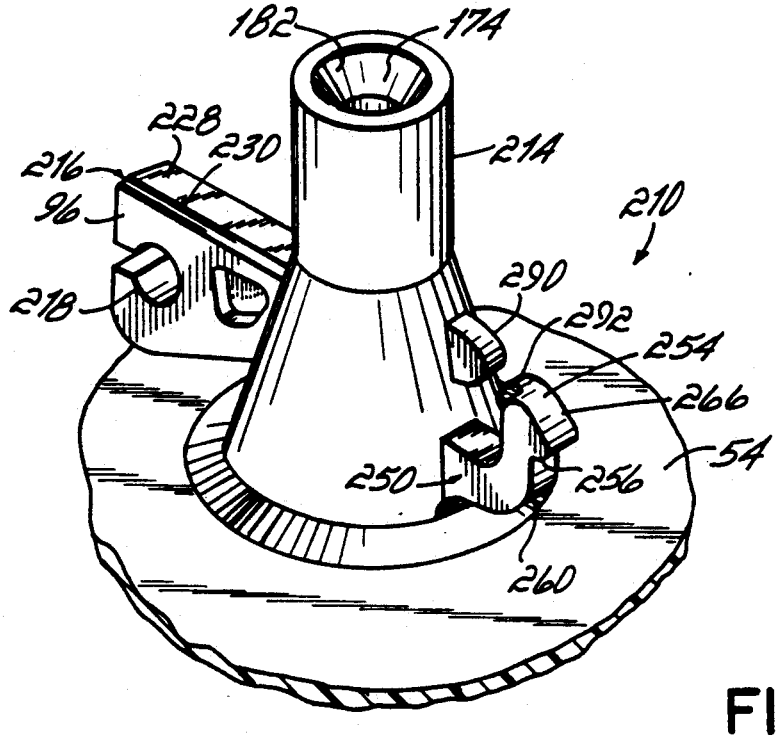
FIG. 24 is a partial perspective view of the dispensing closure of the dropper bottle assembly of FIG. 22.
Figure 25:
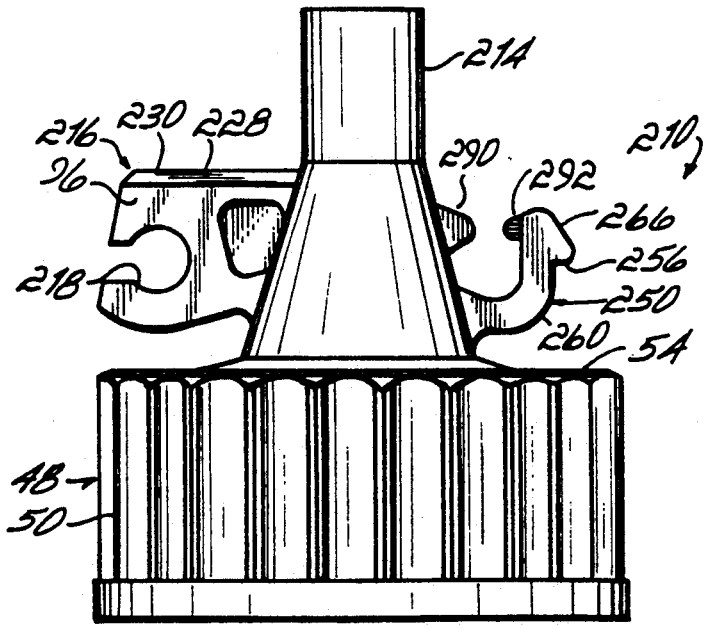
FIG. 25 is a front elevational view of the dispensing closure of FIG. 24.
Figure 26:
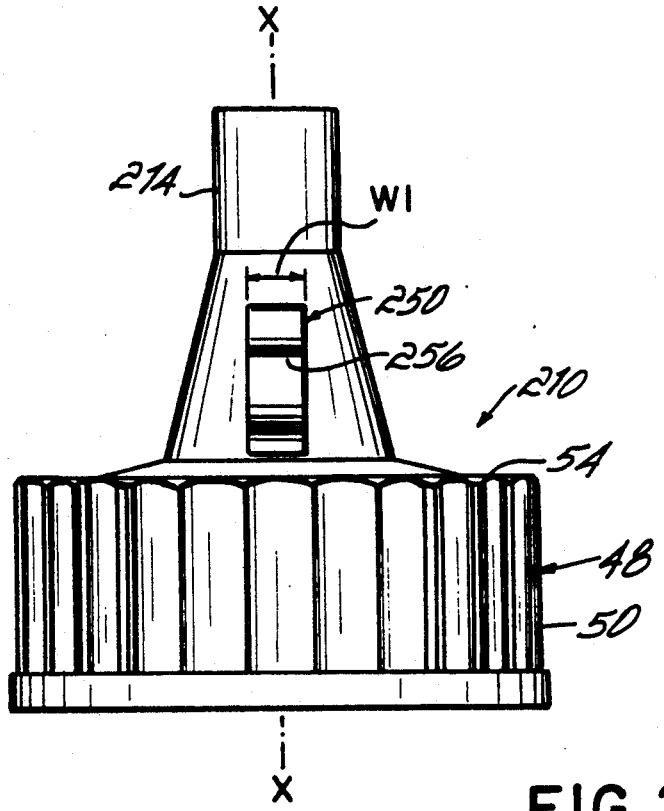
FIG. 26 is a right side elevational view of the dispensing closure of FIG. 24.
Figure 27:
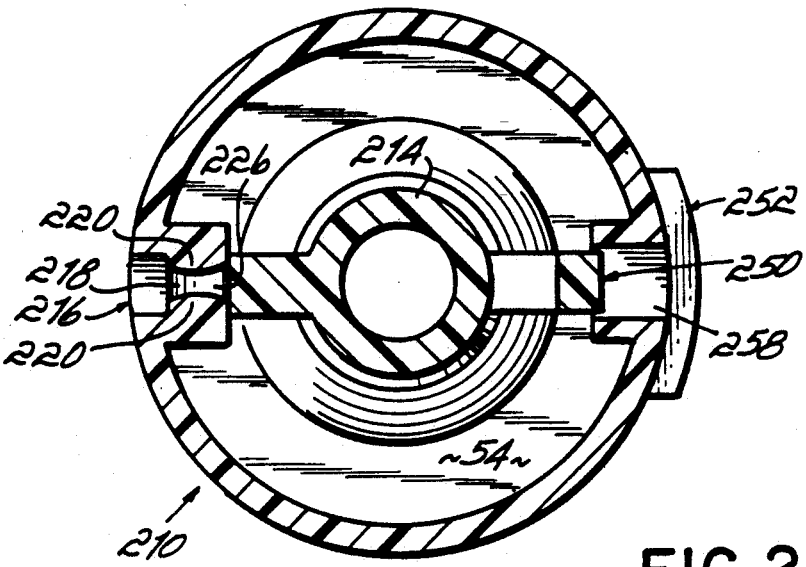
FIG. 27 is a cross-sectional view as taken along line 27—27 of FIG. 22.

Cap 212 may be snapped onto dispensing closure 210 from the top (into the closed position) by camming action between yoke member 216 and hinge pins 220. The top side edge 228 of yoke 216 may also be bevelled as at 230 to further facilitate this mode of assembly (FIGS. 24 and 25). Similarly, cap 212 may be snap fit to yoke 216 in the fully opened position of cap 212 by laterally driving hinge pins 220 into opening 218 in the direction of arrow 232 in FIG. 23.

Figure 31:
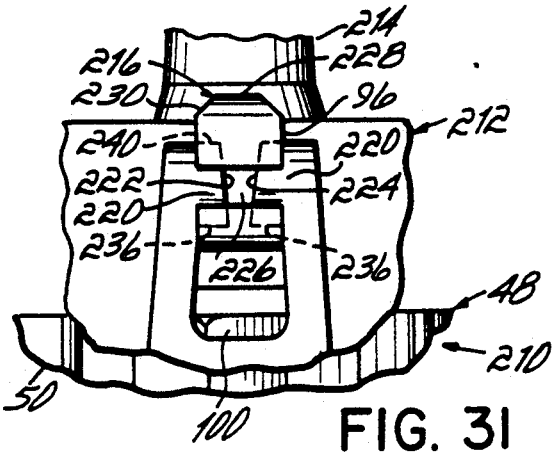
FIG. 31 is a partial left side elevational view of the dropper assembly of FIG. 23.
Figure 32:
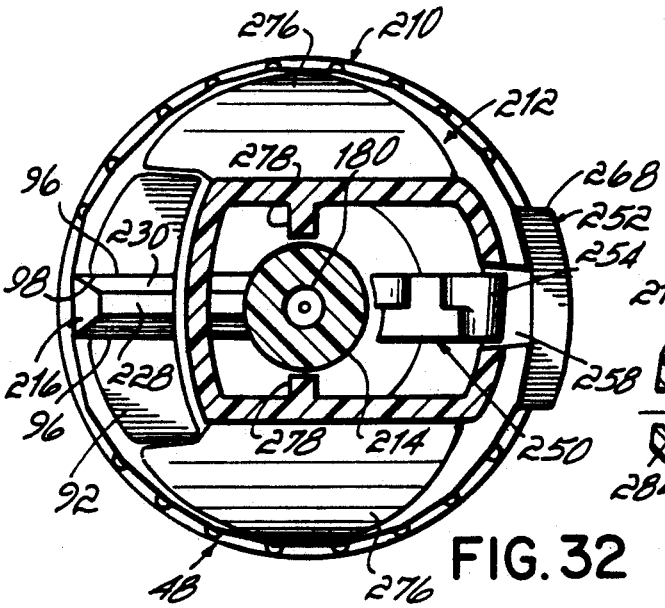
FIG. 32 is a cross-sectional view taken along line 32—32 of FIG. 22.
Figure 33:
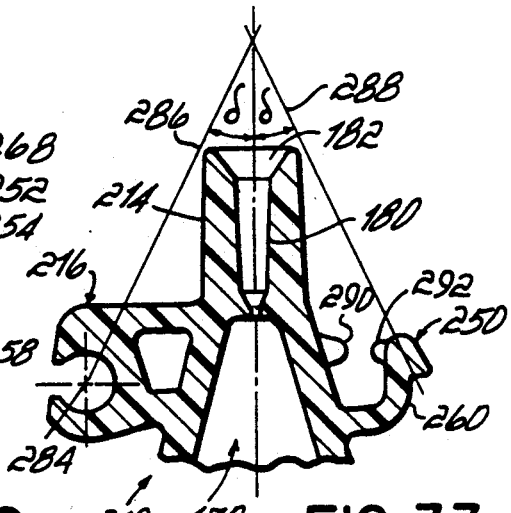
FIG. 33 is a diagrammatic partial cross-sectional view of the dispensing closure of FIG. 22.

Angling cammed surfaces 222, 224 to define downwardly opening gap 226 also provides additional advantages both in maintaining cap 212 closed and sealingly locked against spout 214 and in facilitating non-destructive removal of cap 212 when that is desired. To this end, and with reference to FIGS. 29 and 30, with cap 212 in the closed position, each upper, larger surface 236 of hinge pins 220 provides a maximum bearing surface (about 0.028 inches (0.71 mm) laterally) against the inner top of surface 238 of yoke 216 within opening 218 when pins 220 are under shear to securely hold cap 212 to closure 210. Yet, in the open position of cap 212, as seen in FIG. 31, each lower, short surface 240 (about 0.014 inches 0.36 mm) laterally) of pins 220 now face the inner top surface 238 of yoke 216 to provide a minimum interference therebetween to facilitate non-destructively snapping-off cap 212 from nozzle 210. To this end, ledge 92 in the relieved area 90 of cap 212 bears against top wall 54 of closure 210 with cap 212 in the open position as shown in FIG. 23 such that further pivoting of cap 212 beyond the 180° open position creates a fulcrum-like action to facilitate snapping pins 220 from yoke 216. After use, cap 212 may then be resecured to closure 210 as described above.

To keep cap 212 locked closed to closure 210, a modified locking mechanism is provided which includes a flexible spring-like locking member or arm 250 as a part of closure 210 and a cooperating indexing finger or grip bar 252 molded in cap 212. Locking arm 250 has a generally J-shaped configuration and extends radially from spout 214 such that top section 254 functions much like a tooth to engage grip bar 252 as bar 252 passes thereover (FIGS. 22–25). To this end, top section 254 has a lower surface 256 designed to mate and engage with upper surface 258 of indexing finger 252. Arm 250 is further shaped such that when cap 212 is in the closed position, side surface 260 is adjacent and in substantial contact with surface 262 of grip bar 252. Locking arm 250 is designed to be sufficiently flexible so that top section 254 will deflect a sufficient distance such that it can disengage indexing finger 252 to release cap 212 from the locked position when upward pressure is applied to grip bar 252 to open cap 212 such as by applying finger pressure to lip 268 integral cap 212. Similarly, to close and lock cap 212, ramp surface 264 of grip bar 252 engages upper ramp surface 266 of J-arm end 254 and, by camming action, pushed or flexes arm end 254 until grip bar 252 passes beyond end 254 into the locked position previously described.

In order to seal spout 214 with cap 212, there is provided a generally hemispherical dome shaped projection 270 depending from cap top inner surface 272 into cavity 76 of the cap and positioned in alignment with opening 174 of spout 214. A thin liner or mat 274 of a relatively compliant material is placed against the inner top surface 272 of cap 212 overlying projection 270. Compliant mat 274 tends to conform to opening 174 and projection 270 to thereby assist in providing improved sealing engagement of spout 214 and minimize or prevent leakage therefrom. Mat 274 may be secured against cap top inner surface 272 by adhesive or the like although a purely mechanical friction fit is provided in the preferred embodiment. To this end, as seen in FIG. 28, rectangular mat 274 is sized to fit within the space adjacent cap top inner surface 272. Molded into curved sidewalls 276 and inner surface 272 of cap 212 in the area of surface 272 is at least one and preferably a pair of opposed ribs 278 which extend slightly into cavity 76 of cap 212 and towards mat 274. As a consequence, when mat 274 is pushed against inner surface 272, its lateral edges 280 will compress against ribs 278 as at 282 to thereby frictionally hold mat 274 in place. Ribs 278 preferably also extend downwardly from surface 272 into cavity 76 so as to sit astride spout 214 in the closed position of cap 212 (see FIG. 32) to thereby minimize the possibility of lateral shifting of cap 212 which might otherwise disengage grip bar 252 from J-arm 250. Ribs 278 are, however, sufficiently spaced from spout 214 that generally simultaneous compression of cap sidewalls 276 will distend cap 212 thereby releasing bar 252 from arm 250.

With cap 212 closed and locked, arm 250 bears downwardly on grip bar 252 to urge cap top 272 and mat 274 against spout 214 thereby sealing off spout outlet 174. Additionally, the force from arm 250 on grip bar 252 is translated to hinge pins 220 placing them under shear against yoke 216 as desired. As may be appreciated from the Figures, the fixed pivot axis 94 of cap 212 and the locking location along surface 256 are on diamatically opposed sides of spout 214 thus minimizing eccentric loading and providing good loading characteristics to seal spout 214. Further, as shown diagramatically in FIG. 33, the midpoint 284 of pivot axis 94 and the midpoint 286 of the locking location preferably intersect a pair of lines 286,288 which are at equal but opposite angles ($\delta$) to the longitudinal axis X—X of spout 214 to thereby provide desirably uniform seating force around the annular seal created at the spout opening.

Mating surfaces 256 and 258 are disposed at respective angles $\phi$ with respect to a line perpendicular to the longitudinal axis X—X of the spout which is also the longitudinal axis of the bottle and the cap in this embodiment. Closure 210 is made of a generally rigid engineering material such as high density polyethylene although polycarbonate plastic material such as GE LEXAN 144R-112 is preferred to provide closure 210 sufficient physical properties to bear up under pressure from cap 212 while allowing some flexing such as of J-arm 250. Alternatively, closure 210 could be made of PETG, PCTG, polysulfone or polyether imide. On the other hand, cap 212 is made of a rigid plastic material, such as a high impact polystyrene plastic material (such as DOW 484) to have a sufficient amount of rigidity to retain its general overall configuration and retain a tight seal on spout 214 when locked closed. Although polycarbonate material could alternatively be used, cap 212 should be able to withstand a closing force of at least 10 lb. without any substantial deformation.

As the material of the J-arm or the grip bar get stiffer, $\phi$ must increase in order to be able to release cap 212 with the same finger pressure or force on lip 268 of cap 212. With the above mentioned materials, a tight seal is maintained while also allowing cap 212 to be easily disengaged from closure 210 with an angle $\phi$ greater than 0° but less than about 15°, preferably in the range of about 5° to 10°. Further preferably, surfaces 256 and 258 have the same angle $\phi$ of about 10°. Similarly, ramp surfaces 264, 266 are at an angle $\gamma$ with respect to longitudinal axis X—X of spout 214. Stiffness of the J-arm and grip bar drive the size of angle $\gamma$ with the angle decreasing as those materials get stiffer. However, to reduce criticality to the amount of overlap of the two surfaces when they first meet, a larger angle $\gamma$ is desired. Preferably, $\gamma$ is from about 5° to 15° with about 10° being preferred for the present materials.

To protect arm 250 from overstressing on opening or closing of cap 212, anti-overstress mechanical stops are provided. To this end, a mechanical stop projection 290 is molded on spout 214 opposite top end 254 of arm 250, and top end 254 is molded with a similar mechanical stop projection or extension 292 to be spaced apart a distance D5 thereby limiting deflection of arm 250 by that amount. Although one or the other of projections 290,292 could be made longer and the other projection eliminated, shared anti-overstressing is preferred. Projection 290 or 292 may thus be seen as preventing arm 250 from overflexing, which could inadvertently damage arm 250 by exceeding the elastic limit of the arm material thus causing permanent deformation or breakage of arm 250 and rendering it inoperative or ineffective. Therefore, the distance D5 between will be varied as desired to accommodate the particular desired flexibility of arm 250, although the distance D5 is preferably no greater than about 0.04 inches (1.016 mm).

Locking member 250 is illustrated as having a cross section T5 ranging from about 0.035 inches to 0.055 inches (0.889 mm to 1.397 mm) and a width W1 of about 0.090 inches (2.286 mm) and is sufficiently flexible to move a distance D5, which is the length of mating surface 256. Also, mat 274 is made out of low density polyethylene (such as CHEVRON 5104) and has a thickness T6 in the range of about 0.020 to 0.040 inches (0.508 to 1.016 mm) and preferably is about 0.030 inches (0.762 mm) thick. Further, as in the case of the other embodiments described above, the portions of the hinge mechanism and locking structure which are formed on closure 210 are at the base of spout 214 but spaced above closure top wall 54 with the advantages previously described.

In use of bottle assembly 200, cap 212 is secured to closure 210 for pivoting about fixed pivot axis 94 with hinge pins 220 rotating snugly within yoke 216. Cap 212 may be locked closed with mat 274 sealing spout 214. To open cap 212, upwardly directed finger pressure is applied to lip 268 which causes J-arm 250 and grip bar 252 to disengage whereupon cap 212 is pivoted to the open position with spout 214 fully exposed for dispensing of drops of fluid. Cap 212 is, however, held to closure 210 during dispensing to avoid contamination. Cap 212 may be over-pivoted to snap-off cap 212 if desired and cap 212 later snapped back onto closure 210. After use, cap 212 is then pivoted closed such that grip bar 252 and J-arm 250 cooperate to again lock cap 212 closed in sealing engagement with spout 214.

While the present invention has been illustrated by the description of alternative embodiments, and while the embodiments have been described in considerable detail, it is not the intention of the applicants to restrict or in any way limit the scope of the appended claims to such detail. Additional advantages and modifications will readily appear to those skilled in the art. For example, yoke 216 and hinge pins 220, or J-arm 250 and grip bar 252, could be interchanged between closure 210 and cap 212. The invention in its broader aspects is therefore not limited to the specific details, representative apparatus and method and illustrative examples shown and described. Accordingly, departures may be made from such details without departing from the scope or spirit of applicants' general inventive concept.

Having described the invention, what is claimed is:

1. A dropper bottle assembly comprising:

a bottle;

a dispensing closure having a base adapted to be secured to the bottle, the dispensing closure further having an elongated dropper spout extending from the base to a distal spout opening;

a cap separate from and non-integral the dispensing closure, the cap defining cavity sized to receive the spout therein, the cap and closure having cooperating hinge means defining a fixed pivot axis for mounting the cap to the closure with the cap being pivotable between a closed position wherein the spout is within the cap cavity and an open position wherein the spout opening is exposed;

a first locating element on the cap and a second locking element on the spout but spaced away from the spout opening, the first and second locking elements cooperating to secure the pivotably mounted cap in the closed position; and seal means on the cap for closing off the spout opening in the closed position of the cap.

2. The dropper bottle assembly of claim 1, one of the locking elements being tooth means and another of the locking elements being finger means, the tooth and finger means for lockingly engaging one another as the cap pivots from the open to the closed position.

3. The dropper bottle assembly of claim 2, the tooth means being a spring-like lock arm and the finger means being a generally rigid grip bar.

4. The dropper bottle assembly of claim 2, the tooth means being a generally non-yielding plurality of teeth formed in at least one row and the finger means being a resilient indexing finger.

5. The dropper bottle assembly of claim 1, the seal means being an inner surface of the cap which sealingly engages the spout opening in the closed position of the cap.

6. The dropper bottle assembly of claim 1, the seal means including a projection depending from the cap and protruding into the cavity to sealingly engage the spout opening in the closed position of the cap.

7. The dropper bottle assembly of claim 6 wherein an opening is provided in the cap around a portion of the projection whereby the projection may flex.

8. The dropper bottle assembly of claim 1, the seal means including a compliant mat held in the cap cavity and positioned to sealingly engage the spout opening in the closed position of the cap.

9. The dropper bottle assembly of claim 8, the cap including at least one rib extending into the cavity and frictionally engaging an edge of the compliant mat such as to hold the mat in the cavity.

10. The dropper bottle assembly of claim 1, the cap including at least one rib extending into the cavity and positioned to sit adjacent the spout to minimize lateral shifting of the cap in the closed position of the cap.

11. The dropper bottle assembly of claim 1, the hinge means including at least one hinge pin and a projecting yoke formed on respective ones of the closure and the cap, the hinge pin being snugly received in an opening formed in the yoke.

12. The dropper bottle assembly of claim 1 wherein part of the hinge means is formed on the closure, the hinge means part and the second locking element being spaced from the closure base.

13. The dropper bottle assembly of claim 1 wherein the bottle has an externally threaded neck portion and wherein the base of the dispensing closure includes an annular skirt with internal threads for engagement with the external threads of the bottle neck portion.

14. The dropper bottle assembly of claim 1, the cap being formed of material rendering the cap deformable whereby axial pressure deforms the cap to release the locking elements from one another.

15. A dropper bottle assembly comprising:

a bottle;

a dispensing closure having a base adapted to be secured to the bottle, the dispensing closure further having an elongated dropper spout extending from the base to a distal spout opening;

a separate cap defining a cavity sized to receive the spout therein, the cap and closure having cooperating hinge means for pivotably mounting the cap to the closure, the cap being pivotable between a closed position wherein the spout is within the cap cavity and an open position wherein the spout opening is exposed;

seal means on the cap for closing off the spout opening in the closed position of the cap; and a plurality of teeth and an indexing finger formed on respective ones of the closure and the cap and positioned to lockingly engage one another as the cap pivots from the open to the closed position whereby to secure the pivotably mounted cap in the closed position.

16. The dropper bottle assembly of claim 15, the teeth being formed on the closure in at least one row generally parallel to the spout and the indexing finger being formed on the cap.

17. The dropper bottle assembly of claim 16, the teeth being formed in two rows generally parallel to the spout and the indexing finger engaging a first of the rows of teeth, the cap further including a second indexing finger formed thereon and positioned to engage a second of the rows of teeth.

18. The dropper bottle assembly of claim 17, the teeth in the first row being staggered with respect to the teeth in the second row whereby to provide a different locking position from row to row.

19. The dropper bottle assembly of claim 15, the seal means being an inner surface of the cap which sealingly engages the spout opening in the closed position of the cap.

20. The dropper bottle assembly of claim 15, the seal means including a projection depending from the cap and protruding into the cavity to sealingly engage the spout opening in the closed position of the cap.

21. The dropper bottle assembly of claim 20 wherein an opening is provided in the cap around a portion of the projection whereby the projection may flex.

22. The dropper bottle assembly of claim 15, the cap including at least one rib extending into the cavity and positioned to sit adjacent the spout to minimize lateral shifting of the cap in the closed position of the cap.

23. The dropper bottle assembly of claim 15, the hinge means including at least one hinge pin and a projecting yoke formed on respective ones of the closure and the cap, the hinge pin being received in an opening formed in the yoke.

24. The dropper bottle assembly of claim 15, the hinge means defining a fixed pivot axis about which the cap pivots between the open and closed positions.

25. The dropper bottle assembly of claim 15 wherein respective parts of the hinge means and the plurality of teeth and indexing finger are formed on the closure, those respective parts each being spaced from the closure base.

26. The dropper bottle assembly of claim 15, wherein the bottle has an externally threaded neck portion and wherein the base of the dispensing closure includes an annular skirt with internal threads for engagement with the external threads of the bottle neck portion.

27. The dropper bottle assembly of claim 15, the cap being formed of material rendering the cap deformable whereby axial pressure deforms the cap to release the finger from the teeth.

28. A dropper bottle assembly comprising:

a bottle;

a dispensing closure having a base adapted to be secured to the bottle, the dispensing closure further having an elongated dropper spout extending from the base to a distal spout opening;

a separate cap defining a cavity sized to receive the spout therein, the cap and closure having cooperating hinge means for pivotably mounting the cap to the closure, the cap being pivotable between a closed position wherein the spout is within the cap cavity and an open position wherein the spout opening is exposed;

seal means on the cap for closing off the spout opening in the closed position of the cap; and a lock arm and a grip bar formed on respective ones of the closure and the cap, the arm having a deflectable top section with a mating surface for locking engagement with the grip bar, the grip bar being positioned to deflect the lock arm top section and then lock into engagement with the arm mating surface when the cap is pivoted into the closed position whereby to secure the pivotably mounted cap in the closed position.

29. The dropper bottle assembly of claim 28, the grip bar having a mating surface for locking engagement with the arm mating surface, the arm and grip bar mating surfaces being disposed at first and second angles, respectively, with respect to a plane perpendicular to the longitudinal axis of the spout.

30. The dropper bottle assembly of claim 29, the first and second angles each being selected based upon the stiffness of the materials comprising the lock arm and the grip bar such that the grip bar may be unlocked from the lock arm with finger pressure on the grip bar.

31. The dropper bottle assembly of claim 29, the first and second angles each being between about 0° and about 15°.

32. The dropper bottle assembly of claim 31, the first and second angles each being about 10°.

33. The dropper bottle assembly of claim 28, the lock arm and the grip bar each having a respective ramp surface, the ramp surfaces being positioned such that the grip bar deflects the lock arm by overlapping contact between the ramp surfaces as the cap is pivoted into the closed position.

34. The dropper bottle assembly of claim 33, each of the ramp surfaces being inclined at a respective angle with respect to the longitudinal axis of the spout, the ramp surface angles being selected based upon the stiffness of the materials comprising the lock arm and the grip bar such that the ramp surfaces sufficiently overlap as the cap is pivoted to the closed position to deflect the lock arm.

35. The dropper bottle assembly of claim 33, each of the ramp surfaces being inclined at a respective angle in the range of about 5° to about 15° with respect to the longitudinal axis of the spout.

36. The dropper bottle assembly of claim 35, wherein the ramp angles are each about 10°.

37. The dropper bottle assembly of claim 28 further comprising anti-overstress means for limiting deflection of the lock arm top section.

38. The dropper bottle assembly of claim 37, the anti-overstress means including a projection formed on the one of the closure and the cap on which the arm is formed, the projection being spaced from the lock-arm top section in the direction of deflection thereof.

39. The dropper bottle assembly of claim 38, the anti-overstress means including a second projection formed on the arm top section and projecting toward the first-mentioned anti-overstress projection.

40. The dropper bottle assembly of claim 28, the anti-overstress projections being spaced apart a distance approximately equal to the length of the arm mating surface.

41. The dropper bottle assembly of claim 28, the arm being formed on the closure and the grip bar being formed on the cap.

42. The dropper bottle assembly of claim 28, the seal means being an inner surface of the cap which sealingly engages the spout opening in the closed position of the cap.

43. The dropper bottle assembly of claim 28, the seal means including a projection depending from the cap and protruding into the cavity to sealingly engage the spout opening in the closed position of the cap.

44. The dropper bottle assembly of claim 43 wherein an opening is provided in the cap around a portion of the projection whereby the projection may flex.

45. The dropper bottle assembly of claim 28, the cap including at least one rib extending into the cavity and positioned to sit adjacent the spout to minimize lateral shifting of the cap in the closed position of the cap.

46. The dropper bottle assembly of claim 28, the hinge means including at least one hinge pin and a projecting yoke formed on respective ones of the closure and the cap, the hinge pin being received in an opening formed in the yoke.

47. The dropper bottle assembly of claim 28, the hinge means defining a fixed pivot axis about which the cap pivots between the open and closed positions.

48. The dropper bottle assembly of claim 28 wherein part of the hinge means is formed on the closure, the hinge means part and the one of the lock arm and grip bar formed on the closure being spaced from the closure base.

49. The dropper bottle assembly of claim 28, wherein the bottle has an externally threaded neck portion and wherein the base of the dispensing closure includes an annular skirt with internal threads for engagement with the external threads of the bottle neck portion.

50. The dropper bottle assembly of claim 28, the arm being substantially J-shaped.

51. A dropper bottle assembly comprising:

a bottle;

a dispensing closure having a base adapted to be secured to the bottle, the dispensing closure further having an elongated dropper spout extending from the base to a distal spout opening;

a separate cap defining a cavity sized to receive the spout therein, the cap and closure having cooperating hinge means for pivotably mounting the cap to the closure, the cap being pivotable between a closed position wherein the spout is within the cap cavity and an open position wherein the spout opening is exposed, the cap and closure further having cooperating locking means for securing the pivotably mounted cap in the closed position; and seal means on the cap for closing off the spout opening in the closed position of the cap, the hinge means including a pair of substantially axially aligned spaced apart hinge pins and a yoke disposed on respective ones of the closure and the cap, the hinge pins being snugly received in an opening formed in the yoke to define a fixed pivot axis and having confronting, oppositely angled surfaces to define an everwidening gap between the hinge pins, the surfaces being angled such as to provide a substantial bearing surface against an upper surface of the yoke opening in the closed position of the cap and a minimal interface thereagainst in the open position of the cap whereby to provide generally non-destructive assembly and removal of the cap to and from the closure while providing a generally secure hold on the closed cap.

52. The dropper bottle assembly of claim 51, the cap having a ledge spaced near the locking means and positioned to act as a fulcrum-like lever with the closure base upon pivoting the cap beyond the open position whereby to snap the cap from the closure.

53. The dropper bottle assembly of claim 52, the cap being sized to fit within the periphery of the closure base, the cap being relieved in an area adjacent the ledge to permit approximately 180° pivot of the cap between the closed and open position of the cap.

54. The dropper bottle assembly of claim 51, the hinge means further including a pair of walls each supporting a respective hinge pin, the walls being deflectable to allow the hinge pins to be urged apart as the yoke is inserted therebetween and then urged back into the opening in the yoke, the pair of walls being spaced apart a distance such as to frictionally engage the yoke with the hinge pins in the opening thereof whereby to assist in holding the cap in any position between the open and closed positions.

55. The dropper bottle assembly of claim 51, the locking means including tooth means and finger means formed on respective ones of the closure and the cap for lockingly engaging as the cap pivots from the open to the closed position.

56. The dropper bottle assembly of claim 55, the tooth means being a spring-like lock arm and the finger means being a generally rigid grip bar.

57. The dropper bottle assembly of claim 55, the tooth means being a generally non-yielding plurality of teeth formed in at least one row and the finger means being a resilient indexing finger.

58. The dropper bottle assembly of claim 51, the seal means being an inner surface of the cap which sealingly engages the spout opening in the closed position of the cap.

59. The dropper bottle assembly of claim 51, the seal means including a projection depending from the cap and protruding into the cavity to sealingly engage the spout opening in the closed position of the cap.

60. The dropper bottle assembly of claim 59 wherein an opening is provided in the cap around a portion of the projection whereby the projection may flex.

61. The dropper bottle assembly of claim 51, the seal means including a compliant mat held in the cap cavity and positioned to sealingly engage the spout opening in the closed position of the cap.

62. The dropper bottle assembly of claim 61, the cap including at least one rib extending into the cavity and frictionally engaging an edge of the compliant mat such as to hold the mat in the cavity.

63. The dropper bottle assembly of claim 51, the cap including at least one rib extending into the cavity and positioned to sit adjacent the spout to minimize lateral shifting of the cap in the closed position of the cap.

64. The dropper bottle assembly of claim 51 wherein part of the locking means is formed on the closure, the locking means part and the one of the yoke and the hinge pins formed on the closure being spaced from the closure base.

65. The dropper bottle assembly of claim 51 wherein the bottle has an externally threaded neck portion and wherein the base of the dispensing closure includes an annular skirt with internal threads for engagement with the external threads of the bottle neck portion.

66. A dropper bottle assembly of claim 51, the angle of the hinge pin surfaces each being about 10° with respect to a plane through the longitudinal axis of the spout.

67. The dropper bottle assembly of claim 51, the cap being formed of material rendering the cap deformable whereby axial pressure deforms the cap to release the cooperating locking means.

68. A dropper bottle assembly comprising:

a bottle;

a dispensing closure having a base adapted to be secured to the bottle, the dispensing closure further having an elongated dropper spout extending from the base to a distal spout opening;

a separate cap defining a cavity sized to receive the spout therein, the cap and closure having cooperating hinge means for pivotably mounting the cap to the closure, the cap being pivotable between a closed position wherein the spout is within the cap cavity and an open position wherein the spout opening is exposed, the cap and closure further having cooperating locking means for securing the pivotably mounted cap in the closed position;

seal means on the cap for closing off the spout opening in the closed position of the cap, the seal means including a complaint mat held in the cap cavity and positioned to close off the spout opening in the closed position of the cap; and at least one rib in the cap cavity in engagement with an edge of the mat such as to hold the mat in place in the cavity.

69. The dropper bottle assembly of claim 68, the seal means further including a projection formed on one of the cap and the mat to enhance sealing of the spout opening.

70. The dropper bottle assembly of claim 68, the mat being positioned against an inner surface of the cap which overlies the spout opening in the closed position of the cap, the seal means further including a projection depending from the cap inner surface above the spout opening whereby to form a projection-like bulge in the mat which sealingly engages the spout opening in the closed position of the cap.

71. The dropper bottle assembly of claim 68, the rib extending through the cavity such as to sit adjacent the spout to minimize lateral shift of the cap in the closed position of the cap.

72. The dropper bottle assembly of claim 68, the locking means including tooth means and finger means formed on respective ones of the closure and the cap for lockingly engaging as the cap pivots from the open to the closed position.

73. The dropper bottle assembly of claim 72, the tooth means being a resilient lock arm and the finger means being a generally rigid grip bar.

74. The dropper bottle assembly of claim 72, the tooth means being a generally non-yielding plurality of teeth formed in at least one row and the finger means being a resilient indexing finger.

75. The dropper bottle assembly of claim 68, the hinge means including at least one hinge pin and a projecting yoke formed on respective ones of the closure and the cap, the hinge pin being received in an opening formed in the yoke.

76. The dropper bottle assembly of claim 68, the hinge means defining a fixed pivot axis about which the cap pivots between the open and closed positions.

77. The dropper bottle assembly of claim 68 wherein respective parts of the locking means and the hinge means are formed on the closure, those respective parts being spaced from the closure base.

78. The dropper bottle assembly of claim 68 wherein the bottle has an externally threaded neck portion and wherein the base of the dispensing closure includes an annular skirt with internal threads for engagement with the external threads of the bottle neck portion.

79. The dropper bottle assembly of claim 68, the cap being formed of material rendering the cap deformable whereby axial pressure deforms the cap to release the cooperating locking means.

80. The dropper bottle assembly of claim 68 further comprising:

a second rib in the cap cavity spaced from the first rib and in engagement with a second edge of the complaint mat.

81. The dropper bottle assembly of claim 80, the ribs extending through the cavity such as to sit adjacent the spout to minimize lateral shift of the cap in the closed position.

82. A dropper bottle assembly comprising:

a bottle;

a dispensing closure having a base adapted to be secured to the bottle, the dispensing closure further having an elongated dropper spout extending from the base to a distal spout opening;

a separate cap defining a cavity sized to receive the spout therein, the cap and closure having cooperating hinge means for pivotably mounting the cap to the closure, the cap being pivotable between a closed position wherein the spout is within the cap cavity and an open position wherein the spout opening is exposed;

a first locking element on the cap and a second locking element on the closure but spaced away from the spout opening, the first and second locking elements cooperating with one another to secure the pivotably mounted cap in the closed position; and seal means on the cap for closing off the spout opening in the closed position of the cap, the hinge means and the locking elements defining a fixed pivot axis and a locking location, respectively, the hinge means and locking elements being spaced apart and positioned such that the pivot axis and locking location are intersected by a respective line of a pair of lines disposed from a common point on the longitudinal axis of the spout and at equal angles with respect to the longitudinal axis of the spout.

83. The dropper bottle assembly of claim 82, the pivot axis and the locking location being to diametrically opposed sides of the spout.

84. The dropper bottle assembly of claim 82, the cap being formed of material rendering the cap deformable whereby axial pressure deforms the cap to release, the locking elements from one another.

* * * * *

UNITED STATES PATENT AND TRADEMARK OFFICE

CERTIFICATE OF CORRECTION

PATENT NO. : 5,246,145

DATED : September 21, 1993

INVENTOR(S) : Richard A. Leoncavallo, et al

It is certified that error appears in the above-indentified patent and that said Letters Patent is hereby corrected as shown below:

Column 11, line 40 "modified ca" should read --modified cap--.

Column 15, line 18 "locating" should read --locking--.

Column 18, line 19 "claim 28" should read --claim 38--.

Signed and Sealed this

Second Day of August, 1994

Bruce Lehman

*Attest:*

BRUCE LEHMAN

*Attesting Officer*

*Commissioner of Patents and Trademarks*